US006514680B2

(12) United States Patent
Matsuda et al.

(10) Patent No.: US 6,514,680 B2
(45) Date of Patent: Feb. 4, 2003

(54) SILVER HALIDE COLOR PHOTOGRAPHIC LIGHT-SENSITIVE MATERIAL

(75) Inventors: Naoto Matsuda, Minami-Ashigara (JP); Hisashi Mikoshiba, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/873,197

(22) Filed: Jun. 5, 2001

(65) Prior Publication Data

US 2002/0037484 A1 Mar. 28, 2002

(30) Foreign Application Priority Data

Jun. 5, 2000 (JP) ..... 2000-168148

(51) Int. Cl.[7] ..... G03C 1/765; G03C 1/91; G03C 1/795; G03C 7/38

(52) U.S. Cl. ..... 430/496; 430/505; 430/531; 430/533; 430/534; 430/535; 430/539

(58) Field of Search ..... 430/533, 534, 430/531, 535, 539, 505, 496

(56) References Cited

U.S. PATENT DOCUMENTS 5,368,997 A * 11/1994 Kawamoto ..... 430/534
5,597,682 A * 1/1997 Ishii et al. ..... 430/534

FOREIGN PATENT DOCUMENTS

JP 7-64257 3/1995

* cited by examiner

*Primary Examiner*—Richard L. Schilling
(74) *Attorney, Agent, or Firm*—Birch, Stewart, Kolasch & Birch, LLP

(57) ABSTRACT

A silver halide color photographic light-sensitive material having at least one blue-sensitive emulsion layer, at least one green-sensitive emulsion layer, and at least one red-sensitive emulsion layer on a transparent support, wherein the transparent support is a plastic support having two surfaces undercoated with an undercoat solution containing at least one compound selected from the group consisting of a water-miscible organic solvent except for alcohols, a substituted phenol having a molecular weight of 200 or less, and a substituted acetic acid in which at least one hydrogen atom on a methyl group of acetic acid is substituted with a halogen atom, and at least one photosensitive emulsion layer contains a specific coupler.

16 Claims, No Drawings

SILVER HALIDE COLOR PHOTOGRAPHIC LIGHT-SENSITIVE MATERIAL

CROSS-REFERENCE TO RELATED APPLICATIONS

This application is based upon and claims the benefit of priority from the prior Japanese Patent Application No. 2000-168148, filed Jun. 5, 2000, the entire contents of which are incorporated herein by reference.

BACKGROUND OF THE INVENTION

The present invention relates to a silver halide color photographic light-sensitive material and, more particularly, to a silver halide color reversal photographic light-sensitive material.

A silver halide color photographic light-sensitive material is usually formed by a coating on a cellulose triacetate support and processed into the form of a product after that. For example, a 135 film is generally wound into a magazine and sealed in a plastic case. Sheet films are stacked (the number of sheets is 10 in many cases), and cardboards are arranged on the two sides of the stacked films. After that, these sheet films and cardboards are placed in a plastic-laminated, light-shielding paper bag and sealed. A so-called Brownie film is commonly wound together with light-shielding paper and put into a plastic-laminated bag.

Films are thus stored as they are sealed during the period from the manufacture to the time users load them into cameras. Therefore, the storage stability in the form of a product is an important quality.

The storage stability in the sealed state and that in an open system often lead to different results. For example, a volatile organic solvent used in the process of manufacturing a support and a nonvolatile organic solvent used in emulsion dispersion of organic compounds contained in hydrophilic colloid layers such as photosensitive emulsion layers sometimes remain in a light-sensitive material to generate solvent gases which adversely affect the film in a sealed container.

A plastic support used in a light-sensitive material is usually undercoated with gelatin, before photosensitive emulsion layers are coated, for the purposes of, e.g., improving the adhesion between the plastic support and hydrophilic colloid layers of the light-sensitive material. The undercoat solution often contains a water-miscible organic solvent in addition to gelatin and water. As this water-miscible organic solvent, ketones such as acetone are used in some cases. Unfortunately, conventional silver halide color photographic light-sensitive materials, particularly films using 4-equivalent pyrazolone magenta couplers are readily influenced by these residual solvents. Consequently, the photographic properties vary during storage in the form of a product.

The present inventors made extensive studies and have found that this influence of residual solvents is far larger in product forms in which the two surfaces of a plastic support must be undercoated, such as a sheet film and Brownie film, and in a sheet film commonly using a plastic support having a thickness of about 200 $\mu$m, than in a 135 film. Sheet films and Brownie films are often used by professional photographers, so high storage stability has been strongly demanded also in this respect.

In theory, the influence of solvents remaining in the base can be decreased by enhancing drying in the base manufacturing process. However, enhanced drying worsens the brittleness of the base. In practice, therefore, it is an unavoidable problem that solvents remain.

Meanwhile, coloring materials (more specifically, photographic couplers) for giving preferred color hue have been studied in order to improve the color reproduction of a color film. A pyrazolotriazole magenta coupler is widely known as a magenta coupler which causes little side absorption.

Also, base types and undercoating of silver halide photographic light-sensitive materials containing 2-equivalent pyrazolotriazole couplers are described in, e.g., Jpn. Pat. Appln. KOKAI Publication No. (hereinafter referred to as JP-A-)7-64257.

When, however, the present inventors made extensive studies, pyrazolotriazole couplers increased the unevenness produced during coating of photosensitive emulsion layers, compared to the conventionally used pyrazolone magenta couplers. This unevenness is further conspicuous in relatively large-sized films such as sheet films, so improvements have been desired.

BRIEF SUMMARY OF THE INVENTION

It is an object of the present invention to provide a silver halide color photographic light-sensitive material having high storage stability in the form of a product.

The present inventors made extensive studies to achieve the above object and have found that light-sensitive materials having the following arrangements have high storage stability in the form of a product, thereby completing the present invention.

(1) A silver halide color photographic light-sensitive material having at least one blue-sensitive emulsion layer, at least one green-sensitive emulsion layer, and at least one red-sensitive emulsion layer on a transparent support, wherein the transparent support is a plastic support having two surfaces undercoated with an undercoat solution containing at least one compound selected from the group consisting of a water-miscible organic solvent except for alcohols, a substituted phenol having a molecular weight of 200 or less, and a substituted acetic acid in which at least one hydrogen atom on a methyl group of acetic acid is substituted with a halogen atom, and at least one photosensitive emulsion layer contains a coupler represented by formula (MC-I):

(MC-I)

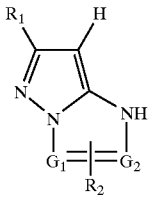

where $R_1$ represents a hydrogen atom or a substituent, one of $G_1$ and $G_2$ represents a carbon atom and the other represents a nitrogen atom, $R_2$ represents a substituent on one of $G_1$ and $G_2$ which is the carbon atom, and $R_1$ and $R_2$ may further have substituents, wherein a plurality of the couplers may be bonded together through $R_1$ or $R_2$ to form a polymer, or the coupler may be bonded to a polymer chain through $R_1$ or $R_2$.

(2) A silver halide color photographic light-sensitive material having at least one blue-sensitive emulsion layer, at least one green-sensitive emulsion layer, and at least one red-sensitive emulsion layer on a transparent support, wherein the transparent support is a plastic support having a thickness of 150 to 2000 μm and having at least one surface undercoated with an undercoat solution containing at least one compound selected from the group consisting of a water-miscible organic solvent except for alcohols, a substituted phenol having a molecular weight of 200 or less, and a substituted acetic acid in which at least one hydrogen atom on a methyl group of acetic acid is substituted with a halogen atom, and at least one photosensitive emulsion layer contains a coupler represented by formula (MC-I):

(MC-I)

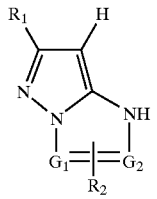

where $R_1$ represents a hydrogen atom or a substituent, one of $G_1$ and $G_2$ represents a carbon atom and the other represents a nitrogen atom, $R_2$ represents a substituent on one of $G_1$ and $G_2$ which is the carbon atom, and $R_1$ and $R_2$ may further have substituents, wherein a plurality of the couplers may be bonded together through $R_1$ or $R_2$ to form a polymer, or the coupler may be bonded to a polymer chain through $R_1$ or $R_2$.

(3) A silver halide color photographic light-sensitive material having at least one blue-sensitive emulsion layer, at least one green-sensitive emulsion layer, and at least one red-sensitive emulsion layer on a transparent support, wherein the light-sensitive material including the support has an acetone content of 0.05% to 3.0% by weight, and at least one photosensitive emulsion layer contains a coupler represented by formula (MC-I):

(MC-I)

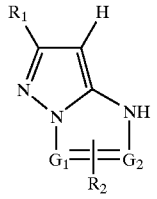

where $R_1$ represents a hydrogen atom or a substituent, one of $G_1$ and $G_2$ represents a carbon atom and the other represents a nitrogen atom, $R_2$ represents a substituent on one of $G_1$ and $G_2$ which is the carbon atom, and $R_1$ and $R_2$ may further have substituents, wherein a plurality of the couplers may be bonded together through $R_1$ or $R_2$ to form a polymer, or the coupler may be bonded to a polymer chain through $R_1$ or $R_2$.

(4) The material according to item (1), wherein the plastic support contains triacetyl cellulose as a main constituent.

(5) The material according to item (2), wherein the plastic support contains triacetyl cellulose as a main constituent.

(6) The material according to item (3), wherein the plastic support contains triacetyl cellulose as a main constituent.

(7) The material according to item (4), wherein the plastic support is undercoated with an undercoat solution containing at least acetone.

(8) The material according to item (5), wherein the plastic support is undercoated with an undercoat solution containing at least acetone.

(9) The material according to item (7), wherein the acetone content in the light-sensitive material is 0.05% to 3.0% as a mass ratio to the light-sensitive material.

(10) The material according to item (8), wherein the acetone content in the light-sensitive material is 0.05% to 3.0% as a mass ratio to the light-sensitive material.

(11) The material according to item (1), wherein, in formula (MC-I), $R_1$ represents a secondary or tertiary alkyl group, $G_1$ represents a carbon atom, and $G_2$ represents a nitrogen atom.

(12) The material according to item (2), wherein, in formula (MC-I), $R_1$ represents a secondary or tertiary alkyl group, $G_1$ represents a carbon atom, and $G_2$ represents a nitrogen atom.

(13) The material according to item (3), wherein, in formula (MC-I), $R_1$ represents a secondary or tertiary alkyl group, $G_1$ represents a carbon atom, and $G_2$ represents a nitrogen atom.

(14) The material according to item (9), wherein, in formula (MC-I), $R_1$ represents a secondary or tertiary alkyl group, $G_1$ represents a carbon atom, and $G_2$ represents a nitrogen atom.

(15) The material according to item (10), wherein, in formula (MC-I), $R_1$ represents a secondary or tertiary alkyl group, $G_1$ represents a carbon atom, and $G_2$ represents a nitrogen atom.

(16) The material according to item (13), wherein a tricresyl phosphate content in the layer containing the coupler represented by formula (MC-I) is from 0 to less than 0.5 as a mass ratio to the coupler represented by formula (MC-1) contained in the same layer.

(17) The material according to item (14), wherein a tricresyl phosphate content in the layer containing the coupler represented by formula (MC-I) is from 0 to less than 0.5 as a mass ratio to the coupler represented by formula (MC-1) contained in the same layer.

(18) The material according to item (15), wherein a tricresyl phosphate content in the layer containing the coupler represented by formula (MC-I) is from 0 to less than 0.5 as a mass ratio to the coupler represented by formula (MC-1) contained in the same layer.

(19) The material according to item (1), wherein, in formula (MC-I), $R_1$ represents a tertiary alkyl group, $G_1$ represents a carbon atom, $G_2$ represents a nitrogen atom, and $R_2$ represents a substituent represented by formula (BL-1) or (BL-2):

(BL-1)

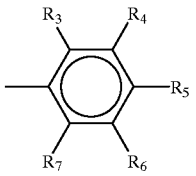

where each of $R_3$, $R_4$, $R_5$, $R_6$, and $R_7$ independently represents a hydrogen atom or a substituent, wherein at least one of them represents a substituent having a total of 4 to 70 carbon atoms and containing a substituted or unsubstituted alkyl group as a partial structure, or a substituent having a total of 6 to 70 carbon atoms and containing a substituted or unsubstituted aryl group as a partial structure.

(BL-2)

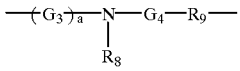

where $G_3$ represents a substituted or unsubstituted methylene group, a represents an integer from 1 to 3, $R_8$ represents a hydrogen atom, an alkyl group, or an aryl group, $G_4$ represents —CO— or —$SO_2$—, and $R_9$ represents a substituent having a total of 6 to 70 carbon atoms and containing a substituted or unsubstituted alkyl group or aryl group as a partial structure, wherein a is 2 or more, and a plurality of $G_3$'s may be the same or different.

(20) The material according to item (2), wherein, in formula (MC-I), $R_1$ represents a tertiary alkyl group, $G_1$ represents a carbon atom, $G_2$ represents a nitrogen atom, and $R_2$ is a substituent represented by formula (BL-1) or (BL-2):

(BL-1)

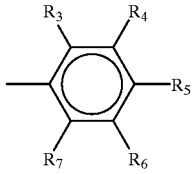

where each of $R_3$, $R_4$, $R_5$, $R_6$, and $R_7$ independently represents a hydrogen atom or a substituent, wherein at least one of them represents a substituent having a total of 4 to 70 carbon atoms and containing a substituted or unsubstituted alkyl group as a partial structure, or a substituent having a total of 6 to 70 carbon atoms and containing a substituted or unsubstituted aryl group as a partial structure.

(BL-2)

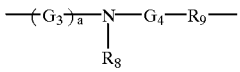

where $G_3$ represents a substituted or unsubstituted methylene group, a represents an integer from 1 to 3, $R_8$ represents a hydrogen atom, an alkyl group, or an aryl group, $G_4$ represents —CO— or —$SO_2$—, and $R_9$ represents a substituent having a total of 6 to 70 carbon atoms and containing a substituted or unsubstituted alkyl group or aryl group as a partial structure, wherein a is 2 or more, and a plurality of $G_3$'s may be the same or different.

(21) The material according to item (3), wherein, in formula (MC-I), $R_1$ represents a tertiary alkyl group, $G_1$ represents a carbon atom, $G_2$ represents a nitrogen atom, and $R_2$ is a substituent represented by formula (BL-1)

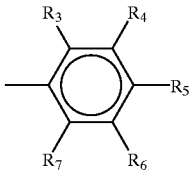

where each of $R_3$, $R_4$, $R_5$, $R_6$, and $R_7$ independently represents a hydrogen atom or a substituent, wherein at least one of them represents a substituent having a total of 4 to 70 carbon atoms and containing a substituted or unsubstituted alkyl group as a partial structure, or a substituent having a total of 6 to 70 carbon atoms and containing a substituted or unsubstituted aryl group as a partial structure.

(BL-2)

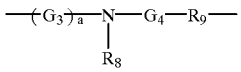

where $G_3$ represents a substituted or unsubstituted methylene group, a represents an integer from 1 to 3, $R_8$ represents a hydrogen atom, an alkyl group, or an aryl group, $G_4$ represents —CO— or —$SO_2$—, and $R_9$ represents a substituent having a total of 6 to 70 carbon atoms and containing a substituted or unsubstituted alkyl group or aryl group as a partial structure, wherein a is 2 or more, and a plurality of $G_3$'s may be the same or different.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The present invention will be described in detail below.

A light-sensitive material provided by the present invention is a silver halide color photographic light-sensitive material having at least one blue-sensitive emulsion layer, at least one green-sensitive emulsion layer, and at least one red-sensitive emulsion layer on a transparent support. One characteristic feature of the material is that at least one of these photosensitive emulsion layers contains a coupler represented by formula (MC-I):

(MC-I)

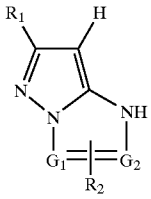

where $R_1$ represents a hydrogen atom or a substituent, $R_2$ represents a substituent, one of $G_1$ and $G_2$ represents a carbon atom and the other represents a nitrogen atom, and $R_2$ represents a substituent on one of $G_1$ and $G_2$ which is the carbon atom. Examples of substituents represented by $R_1$ and $R_2$ are a halogen atom, alkyl group (including a cycloalkyl group and bicycloalkyl group), alkenyl group (including a cycloalkenyl group and bicycloalkenyl group), alkinyl group, aryl group, heterocyclic group, cyano group, hydroxyl group, nitro group, carboxyl group, alkoxy group, aryloxy group, silyloxy group, heterocyclic oxy group, acyloxy group, carbamoyloxy group, alkoxycarbonyloxy group, aryloxycarbonyloxy group, amino group (including an anilino group), acylamino group, aminocarbonylamino group, alkoxycarbonylamino group, aryloxycarbonylamino group, sulfamoylamino group, alkylsulfonylamino and arylsulfonylamino groups, mercapto group, alkylthio group, arylthio group, heterocyclic thio group, sulfamoyl group, sulfo group, alkylsulfinyl and arylsulfinyl groups, alkylsulfonyl and arylsulfonyl groups, acyl group, aryloxycarbonyl group, alkoxycarbonyl group, carbamoyl group, arylazo and heterocyclic azo groups, imide group, phosphino group, phosphinyl group, phosphinyloxy group, phosphinylamino group, and silyl group.

Examples of substituents represented by $R_1$ and $R_2$ will be described in more detail below. A halogen atom (e.g., a chlorine atom, bromine atom, and iodine atom), and an alkyl group [which represents a straight-chain, branched, or cyclic, substituted or unsubstituted alkyl group. Examples are an alkyl group (preferably a 1- to 30-carbon, substituted or unsubstituted alkyl group, e.g., methyl, ethyl, n-propyl, isopropyl, t-butyl, n-octyl, eicosyl, 2-chloroethyl, 2-cyanoethyl, and 2-ethylhexyl), cycloalkyl group (preferably a 3- to 30-carbon, substituted or unsubstituted cycloalkyl group, e.g., cyclohexyl, cyclopentyl, and 4-n-dodecylcyclohexyl), bicycloalkyl group (preferably a 5- to 30-carbon, substituted or unsubstituted bicycloalkyl group, i.e., a monovalent group obtained by removing one hydrogen atom from 5- to 30-carbon bicycloalkane. Examples are bicyclo[1,2,2]heptane-2-yl and bicyclo[2,2,2]octane-3-yl)].

An alkenyl group [which represents a straight-chain, branched, or cyclic, substituted or unsubstituted alkenyl group. Examples are an alkenyl group (preferably a 2- to 30-carbon, substituted or unsubstituted alkenyl group, e.g., vinyl, allyl, prehnyl, geranyl, and oleyl), cycloalkenyl group (preferably a 3- to 30-carbon, substituted or unsubstituted cycloalkenyl group, i.e., a monovalent group obtained by removing one hydrogen atom from 3- to 30-carbon cycloalkene. Examples are 2-cyclopentene-1-yl and 2-cyclohexene-1-yl), bicycloalkenyl group (a substituted or unsubstituted bicycloalkenyl group, preferably a 5- to 30-carbon, substituted or unsubstituted bicycloalkenyl group, i.e., a monovalent group obtained by removing one hydrogen atom from bicycloalkene having one double bond. Examples are bicyclo[2,2,1]hepto-2-ene-1-yl and bicyclo[2,2,2]octo-2-ene-4-yl)].

An alkinyl group (preferably a 2- to 30-carbon, substituted or unsubstituted alkinyl group, e.g., ethynyl, propargyl, and a trimethylsilylethynyl group), aryl group (preferably a 6- to 30-carbon, substituted or unsubstituted aryl group, e.g., phenyl, p-tolyl, naphthyl, m-chlorophenyl, and o-hexadecanoylaminophenyl), heterocyclic group (preferably a monovalent group obtained by removing one hydrogen atom from a 5- or 6-membered, substituted or unsubstituted, aromatic or nonaromatic heterocyclic compound, and more preferably, a 3- to 30-carbon, 5- or 6-membered aromatic heterocyclic group. Examples are 2-furyl, 2-thienyl, 2-pyrimidinyl, and 2-benzothiazolyl), cyano group, hydroxyl group, nitro group, carboxyl group, and alkoxy group (preferably a 1- to 30-carbon, substituted or unsubstituted alkoxy group, e.g., methoxy, ethoxy, isopropoxy, t-butoxy, n-octyloxy, and 2-methoxyethoxy).

An aryloxy group (preferably a 6- to 30-carbon, substituted or unsubstituted aryloxy group, e.g., phenoxy, 2-methylphenoxy, 4-t-butylphenoxy, 3-nitrophenoxy, and 2-tetradecanoylaminophenoxy), silyloxy group (preferably a 3- to 20-carbon silyloxy group, e.g., trimethylsilyloxy and t-butyldimethylsilyloxy), heterocyclic oxy group (preferably a 2- to 30-carbon, substituted or unsubstituted heterocyclic oxy group, e.g., 1-phenyltetrazole-5-oxy and 2-tetrahydropyranyloxy), and acyloxy group (preferably a formyloxy group, 2- to 30-carbon, substituted or unsubstituted alkylcarbonyloxy group, and 6- to 30-carbon, substituted or unsubstituted arylcarbonyloxy group, e.g., formyloxy, acetyloxy, pivaloyloxy, stearoyloxy, benzoyloxy, and p-methoxyphenylcarbonyloxy).

A carbamoyloxy group (preferably a 1- to 30-carbon, substituted or unsubstituted carbamoyloxy group, e.g., N,N-dimethylcarbamoyloxy, N,N-diethylcarbamoyloxy, morpholinocarbonyloxy, N,N-di-n-octylaminocarbonyloxy, and N-n-octylcarbamoyloxy), alkoxycarbonyloxy group (preferably a 2- to 30-carbon, substituted or unsubstituted alkoxycarbonyloxy group, e.g., methoxycarbonyloxy, ethoxycarbonyloxy, t-butoxycarbonyloxy, and n-octylcarbonyloxy), and aryloxycarbonyloxy group (preferably a 7- to 30-carbon, substituted or unsubstituted aryloxycarbonyloxy group, e.g., phenoxycarbonyloxy, p-methoxyphenoxycarbonyloxy, and p-n-hexadecyloxyphenoxycarbonyloxy).

An amino group (including an anilino group) (preferably an amino group, 1- to 30-carbon, substituted or unsubstituted alkylamino group, and 6- to 30-carbon, substituted or unsubstituted anilino group, e.g., amino, methylamino, dimethylamino, anilino, N-methyl-anilino, and diphenylamino), acylamino group (preferably a formylamino group, 1- to 30-carbon, substituted or unsubstituted alkylcarbonylamino group, and 6- to 30-carbon, substituted or unsubstituted arylcarbonylamino group, e.g., formylamino, acetylamino, pivaloylamino, lauroylamino, benzoylamino, and 3,4,5-tri-n-octyloxyphenylcarbonylamino), and aminocarbonylamino group (preferably a 1- to 30-carbon, substituted or unsubstituted aminocarbonylamino, e.g., carbamoylamino, N,N-dimethylaminocarbonylamino, N,N-diethylaminocarbonylamino, and morpholinocarbonylamino).

An alkoxycarbonylamino group (preferably a 2- to 30-carbon, substituted or unsubstituted alkoxycarbonylamino group, e.g., methoxycarbonylamino, ethoxycarbonylamino, t-butoxycarbonylamino, n-octadecyloxycarbonylamino, and N-methylmethoxycarbonylamino), aryloxycarbonylamino group (preferably a 7- to 30-carbon, substituted or unsubstituted aryloxycarbonylamino group, e.g., phenoxycarbonylamino, p-chlorophenoxycarbonylamino, and m-n-octyloxyphenoxycarbonylamino), sulfamoylamino group (preferably a 0- to 30-carbon, substituted or unsubstituted sulfamoylamino group, e.g., sulfamoylamino, N,N-dimethylaminosulfonylamino, and N-n-octylaminosulfonylamino).

Alkylsulfonylamino and arylsulfonylamino groups (preferably 1- to 30-carbon, substituted or unsubstituted alkylsulfonylamino and 6- to 30-carbon, substituted or unsubstituted arylsulfonylamino, e.g., methylsulfonylamino, butylsulfonylamino, phenylsulfonylamino, 2,3,5-trichlorophenylsulfonylamino, and p-methylphenylsulfonylamino), mercapto group, alkylthio group (preferably a 1- to 30-carbon, substituted or unsubstituted alkylthio group, e.g., methylthio, ethylthio, and n-hexadecylthio), arylthio group (preferably a 6- to 30-carbon, substituted or unsubstituted arylthio group, e.g., phenylthio, p-chlorophenylthio, and m-methoxyphenylthio), and heterocyclic thio group (preferably a 3- to 30-carbon, substituted or unsubstituted heterocyclic thio group, e.g., 2-benzothiazolylthio and 1-phenyl-tetrazole-5-ylthio).

A sulfamoyl group (preferably a 0- to 30-carbon, substituted or unsubstituted sulfamoyl group, e.g., N-ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl), sulfo group, alkylsulfinyl and arylsulfinyl groups (preferably a 1- to 30-carbon, substituted or unsubstituted alkylsulfinyl group and 6- to 30-carbon, substituted or unsubstituted arylsulfinyl group, e.g., methylsulfinyl, ethylsulfinyl, phenylsulfinyl, and p-methylphenylsulfinyl).

Alkylsulfonyl and arylsulfonyl groups (preferably a 1- to 30-carbon, substituted or unsubstituted alkylsulfonyl group and 6- to 30-carbon, substituted or unsubstituted arylsulfonyl group, e.g., methylsulfonyl, ethylsulfonyl, phenylsulfonyl, and p-methylphenylsulfonyl), acyl group (preferably a formyl group, 2- to 30-carbon, substituted or unsubstituted alkylcarbonyl group, and 7- to 30-carbon, substituted or unsubstituted arylcarbonyl group, e.g., acetyl, pivaloyl, 2-chloroacetyl, stearoyl, benzoyl, and p-n-octyloxyphenylcarbonyl), aryloxycarbonyl group (preferably a 7- to 30-carbon, substituted or unsubstituted aryloxycarbonyl group, e.g., phenoxycarbonyl, o-chlorophenoxycarbonyl, m-nitrophenoxycarbonyl, and p-t-butylphenoxycarbonyl), and an alkoxycarbonyl group (e.g., a 2- to 30-carbon, substituted or unsubstituted alkoxycarbonyl group, e.g., methoxycarbonyl, ethoxycarbonyl, t-butoxycarbonyl, and n-octadecyloxycarbonyl).

A carbamoyl group (preferably 1- to 30-carbon, substituted or unsubstituted carbamoyl, e.g., carbamoyl, N-methylcarbamoyl, N,N-dimethylcarbamoyl, N,N-di-n-octylcarbamoyl, and N-(methylsulfonyl)carbamoyl), arylazo and heterocyclic azo groups (preferably a 6- to 30-carbon, substituted or unsubstituted arylazo group and 3- to 30-carbon, substituted or unsubstituted heterocyclic azo group, e.g., phenylazo, p-chlorophenylazo, and 5-ethylthio-1,3,4-thiadiazole-2-ylazo), imide group (preferably N-succinimide and N-phthalimide), phosphino group (preferably a 2- to 30-carbon, substituted or unsubstituted phosphino group, e.g., dimethylphosphino, diphenylphosphino, and methylphenoxyphosphino), and phosphinyl group (preferably a 2- to 30-carbon, substituted or unsubstituted phosphinyl group, e.g., phosphinyl, dioctyloxyphosphinyl, and diethoxyphosphinyl).

A phosphinyloxy group (preferably a 2- to 30-carbon, substituted or unsubstituted phosphinyloxy group, e.g., diphenoxyphosphinyloxy and dioctyloxyphosphinyloxy), phosphinylamino group (preferably a 2- to 30-carbon, substituted or unsubstituted phosphinylamino group, e.g., dimethoxyphosphinylamino and dimethylaminophosphinylamino), and silyl group (preferably a 3- to 30-carbon, substituted or unsubstituted silyl group, e.g., trimethylsilyl, t-butyldimethylsilyl, and phenyldimethylsilyl).

Of the above substituents, those having a hydrogen atom may be further substituted by the above groups by removing the hydrogen atom. Examples of such substituents are an alkylcarbonylaminosulfonyl group, arylcarbonylaminosulfonyl group, alkylsulfonylaminocarbonyl group, and arylsulfonylaminocarbonyl group. Examples of these groups are methylsulfonylaminocarbonyl, p-methylphenylsulfonylaminocarbonyl, acetylaminosulfonyl, and a benzoylaminosulfonyl group.

Preferred examples of $R_1$ are a hydrogen atom, alkyl group, aryl group, alkoxy group, aryloxy group, amino group, acylamino group, arylthio group, alkylthio group, aminocarbonylamino group, alkoxycarbonylamino group, carbamoyloxy group, and heterocyclic thio group. These groups may have substituents.

$R_1$ is more preferably an alkyl group, aryl group, alkoxy group, aryloxy group, or amino group (including an anilino group), further preferably, a secondary or tertiary alkyl group having a total of 3 to 15 carbon atoms, and most preferably, a tertiary alkyl group having a total of 4 to 10 carbon atoms.

One of $G_1$ and $G_2$ is a nitrogen atom, and the other is a carbon atom. $R_2$ shown in formula (MC-I) is substituted on one of $G_1$ and $G_2$ which is the carbon atom.

Preferred examples of $R_2$ are an alkyl group, aryl group, alkoxy group, aryloxy group, alkylthio group, aminocarbonylamino group, alkoxycarbonylamino group, and acylamino group. $R_2$ is more preferably a group having a total of 6 to 70 carbon atoms, which contains a 6- to 30-carbon alkyl group or aryl group as a partial structure. This group preferably gives immobility to a coupler represented by formula (MC-I).

In a preferred coupler represented by formula (MC-I), $R_1$ is a secondary or tertiary alkyl group or an aryl group, $R_2$ is a substituted alkyl group or a substituted aryl group, and the substituent which is substituted on $R_2$ is preferably selected from an alkoxy group, aryloxy group, acylamino group, aminocarbonylamino group, alkylthio group, arylthio group, alkoxycarbonylamino group, aryloxycarbonylamino group, alkylsulfonylamino and arylsulfonylamino groups, carbamoyl group, sulfamoyl group, sulfonyl group, alkoxycarbonyl group, acyloxy group, carbamoyloxy group, sulfinyl group, phosphonyl group, acyl group, and halogen atom.

Formula (MC-1) is more preferably a compound in which $R_2$ is a substituent represented by formula (BL-1) or (BL-2) below.

(BL-1)

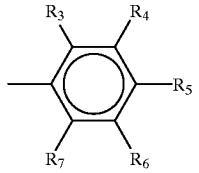

(BL-2)

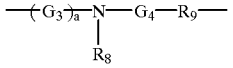

In formula (BL-1), each of $R_3$, $R_4$, $R_5$, $R_6$, and $R_7$ independently represents a hydrogen atom or a substituent, and at least one of them represents a substituent having a total of 4 to 70 carbon atoms and containing a substituted or unsubstituted alkyl group as a partial structure, or a substituent having a total of 6 to 70 carbon atoms and containing a substituted or unsubstituted aryl group as a partial structure.

A group represented by formula (BL-1) will be described below. Each of $R_3$, $R_4$, $R_5$, $R_6$, and $R_7$ independently represents a hydrogen atom or a substituent. Examples of the substituent are those enumerated above for $R_2$. At least one of $R_3$, $R_4$, $R_5$, $R_6$, and $R_7$ is a substituent having a total of 4 to 70 carbon atoms and containing a substituted or unsubstituted alkyl group as a partial structure, or a substituent having a total of 6 to 70 carbon atoms and containing a substituted or unsubstituted aryl group as a partial structure. Preferred examples are an alkoxy group, aryloxy group, acylamino group, aminocarbonylamino group, carbamoyl group, alkoxycarbonylamino group, sulfonyl group, alkylsulfonylamino and arylsulfonylamino groups, sulfamoyl group, sulfamoylamino group, alkoxycarbonyl group, alkyl group, and aryl group, each having a total of 4 (6 if an aryl group is contained) to 70 carbon atoms and containing a substituted or unsubstituted alkyl group or aryl group as a partial structure. Of these substituents, an alkoxy group, acylamino group, and alkylsulfonylamino and arylsulfonylamino groups each having a total of 4 (6 if an aryl group is contained) to 70 carbon atoms and containing an alkyl group or aryl group as a partial structure are preferred.

A group represented by formula (BL-2) will be described next. In formula (BL-2), $G_3$ represents a substituted or unsubstituted methylene group, a represents an integer from 1 to 3, $R_8$ represents a hydrogen atom, alkyl group, or aryl group, $G_4$ represents —CO— or —$SO_2$—, and $R_9$ represents a substituent having a total of 6 to 70 carbon atoms and containing a substituted or unsubstituted alkyl group or aryl group as a partial structure. If $R_9$ has a substituent, examples of this substituent are those enumerated above for $R_2$. If a is 2 or more, a plurality of $G_3$'s may be the same or different. Preferably, a group represented by (G3)a is —$CH_2$—, —$C(CH_3)H$—, —$C(CH_3)_2$—, —$C_2H_4$—, —$C(CH_3)H$—$CH_2$—, —$C(CH_3)_2$—$CH_2$—, —$C(CH_3)_2$—$C(CH_3)H$—, —$C(CH_3)H$—$C(CH_3)H$—, —$C(CH_3)_2$—$C(CH_3)_2$—, —C(i—$C_3H_7$)H—, or —C(i—$C_3H_7$)H—$CH_2$—, $R_8$ is a hydrogen atom, $G_4$ is —CO— or —$SO_2$—, and $R_9$ is a substituted or unsubstituted alkyl group or aryl group having a total of 10 to 70 carbon atoms.

In a compound represented by formula (MC-1), if $G_1$ is a nitrogen atom and $G_2$ is a carbon atom, $R_1$ is preferably a tertiary alkyl group, and $R_2$ is preferably a group represented by formula (BL-1). Most favorably, each of $R_4$ and $R_6$ is a group selected from an acylamino group, sulfonamide group, ureido group, alkoxycarbonylamino group, sulfonyl group, carbamoyl group, sulfamoyl group, sulfamoylamino group, and alkoxycarbonyl group, each substituted by a substituted or unsubstituted alkyl group having a total of 4 or more carbon atoms or by a substituted or unsubstituted aryl group having a total of 6 or more carbon atoms.

If $G_1$ is a carbon atom and $G_2$ is a nitrogen atom in a compound represented by formula (MC-I), $R_1$ is preferably a tertiary alkyl group, and $R_2$ is preferably a group represented by formula (BL-1) or (BL-2). Especially when $R_2$ is a group represented by formula (BL-I), $R_3$ and $R_7$ are favorably 1- to 6-carbon alkyl groups, and at least one of $R_4$, $R_5$, and $R_6$ is favorably a group having a total of 6 to 70 carbon atoms and containing a substituted or unsubstituted alkyl group or aryl group as a partial structure. If $R_2$ is a group represented by formula (BL-2), $R_9$ is preferably a phenyl group having at least one group containing a 6- to 50-carbon alkyl group as a substituent, and a is preferably 1 or 2. $R_9$ is most preferably a group having a group selected from —OH, —$SO_2NH_2$, —$SO_2NHR_{10}$, —$NHSO_2R_{10}$, —$SO_2NHCOR_{10}$, —COOH, and —$CONH_2$ as a partial structure.

$R_{10}$ represents a substituted or unsubstituted alkyl group or aryl group. If $R_{10}$ is an aryl group, this aryl group is favorably a phenyl group, and at least one electron attracting group is preferably substituted on this phenyl group. Preferred examples of this electron attracting group are a halogen atom, a cyano group, an alkyl group on which at least one halogen atom is substituted, an aryl group on which at least one halogen atom is substituted, an acyl group, a carbamoyl group, an alkyloxycarbonyl or aryloxycarbonyl group, a sulfonyl group, and an alkylaminosulfonyl or arylaminosulfonyl group.

If $R_{10}$ is an alkyl group, this alkyl group is preferably a 1- to 50-carbon, and more preferably, 1- to 30-carbon, substituted or unsubstituted, straight-chain or branched alkyl group.

Practical compound examples (couplers (1) to (40)) of formula (MC-1) will be presented below. However, the present invention is not limited to these practical examples.

1

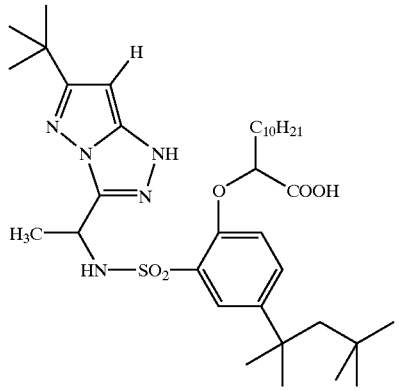

2

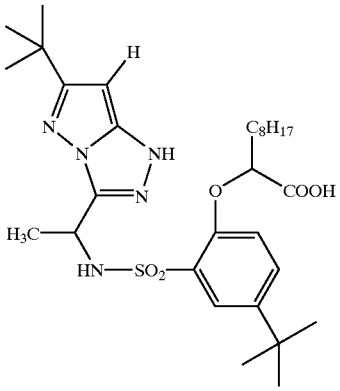

-continued
3
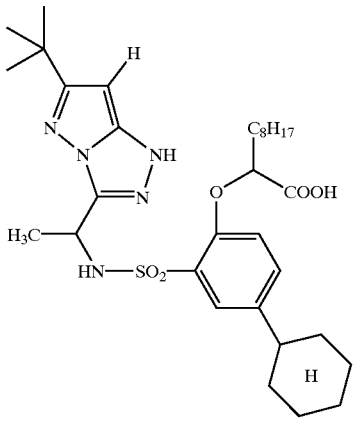
4
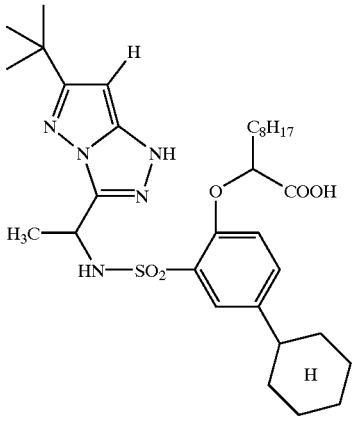
5
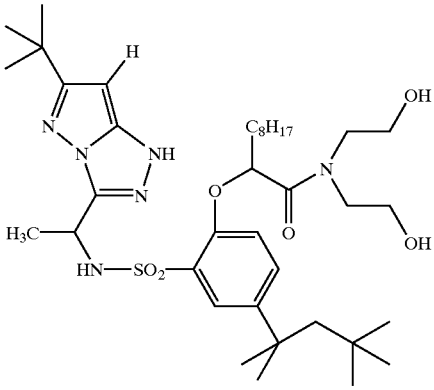
6
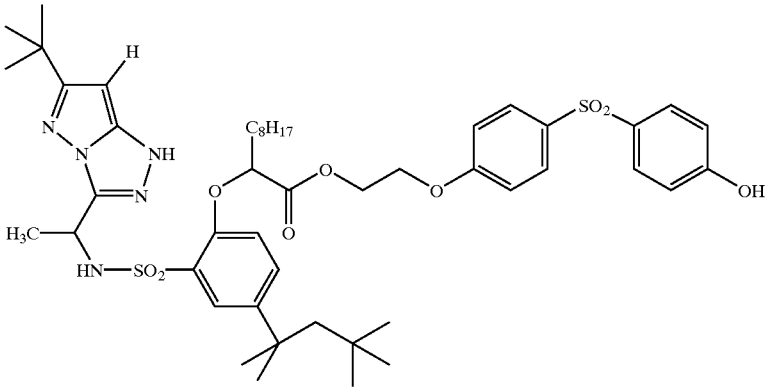
7
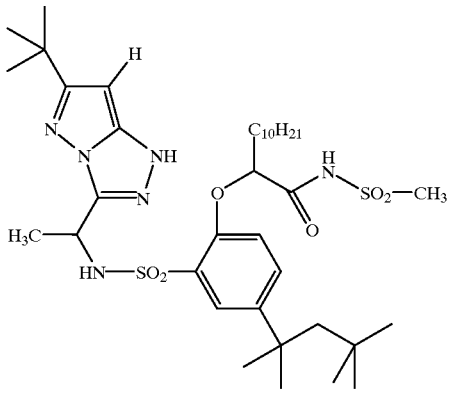
8
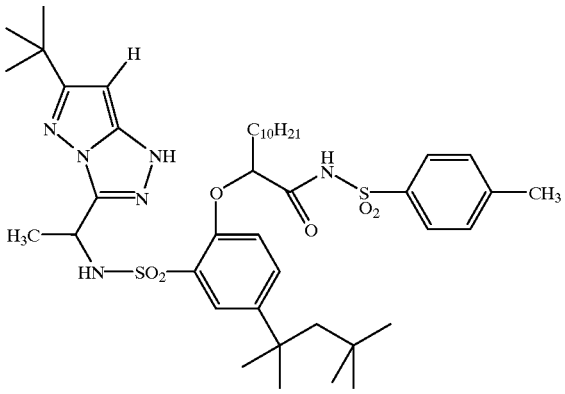

-continued
9
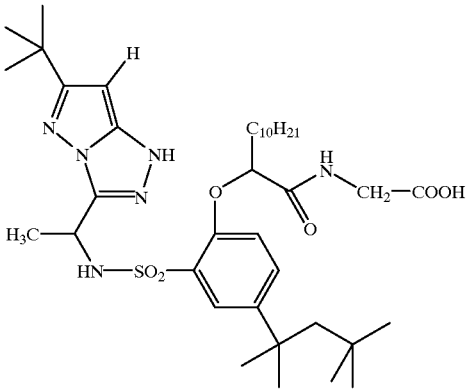
10
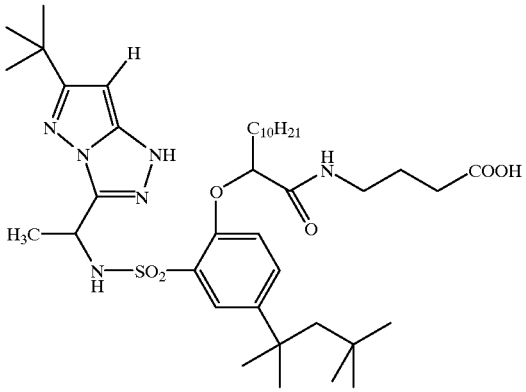
11
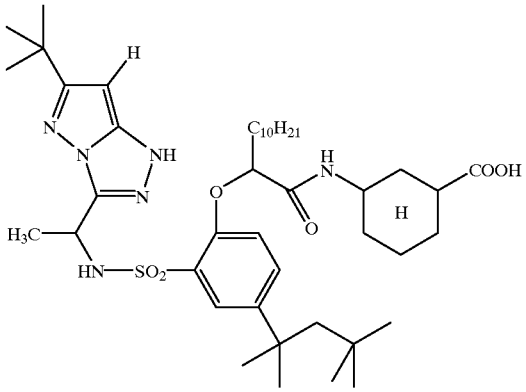
12
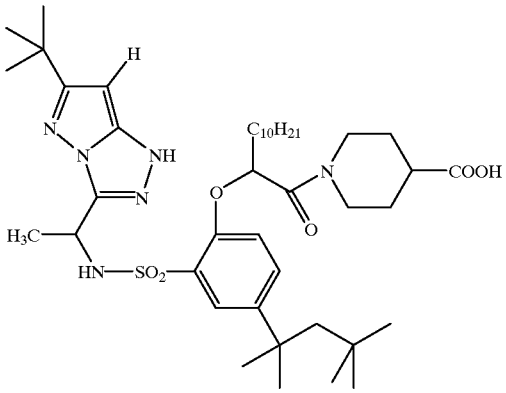
13
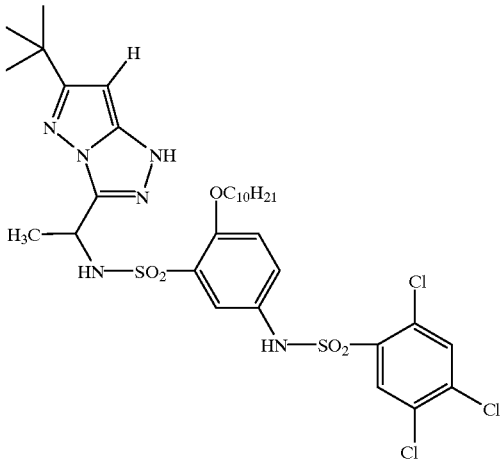
14
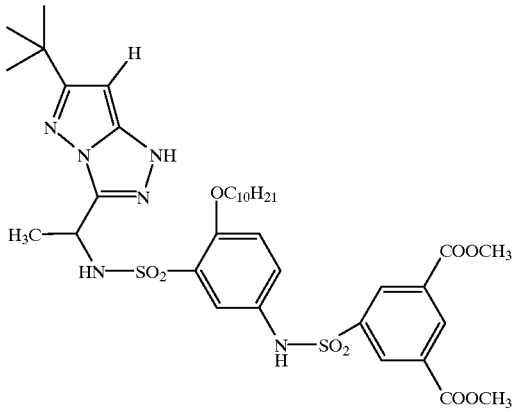

-continued
15
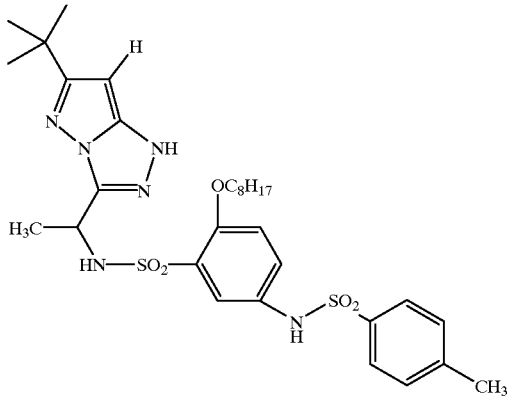
16
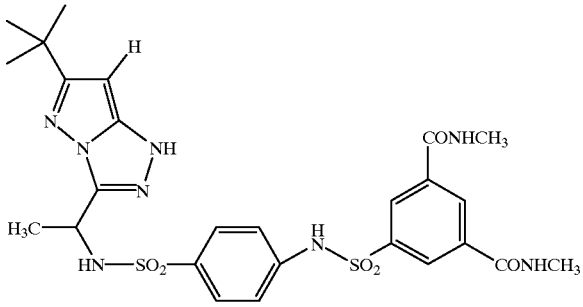
17
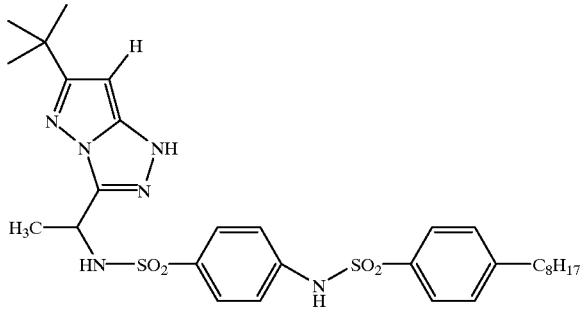
18
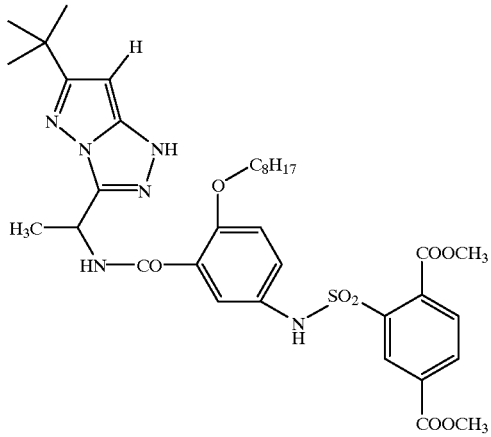
19
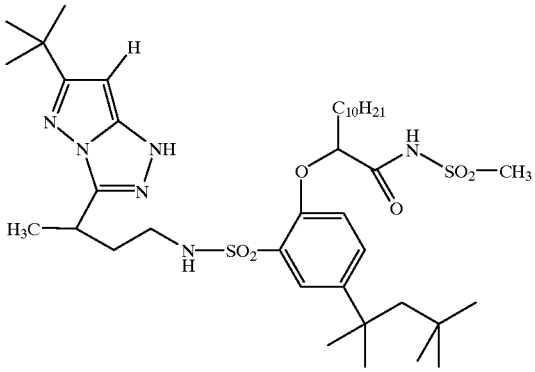
20
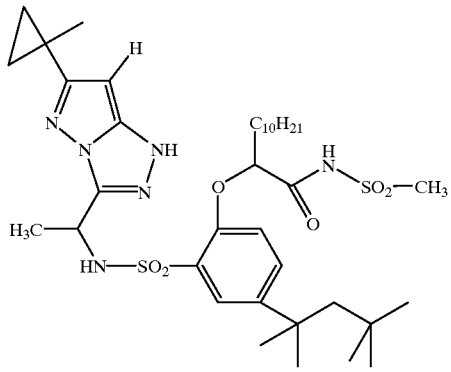

-continued
21
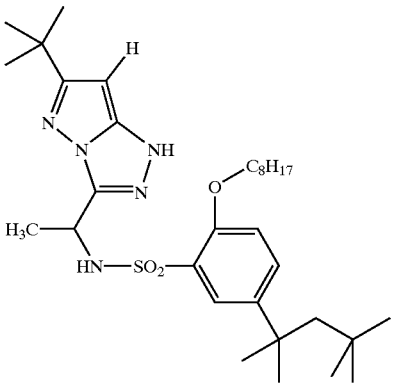
22
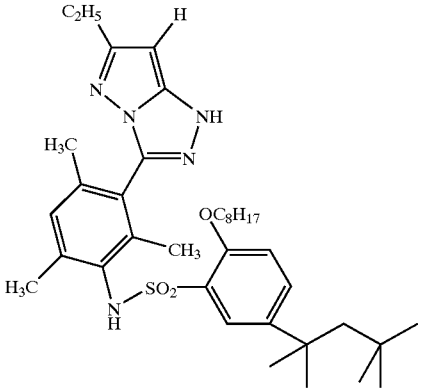
23
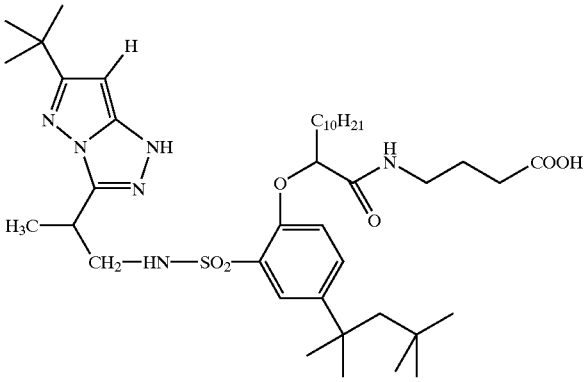
24
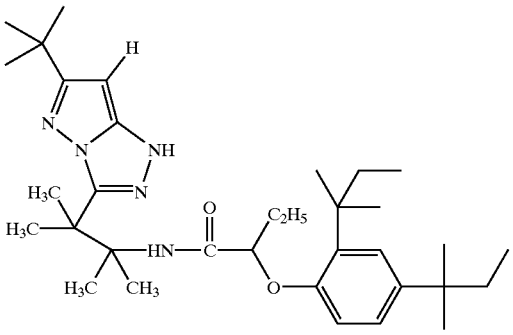
25
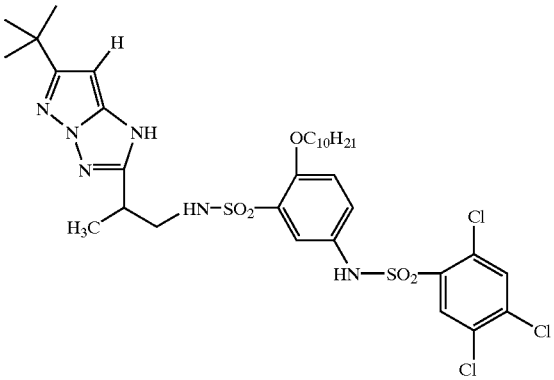
26
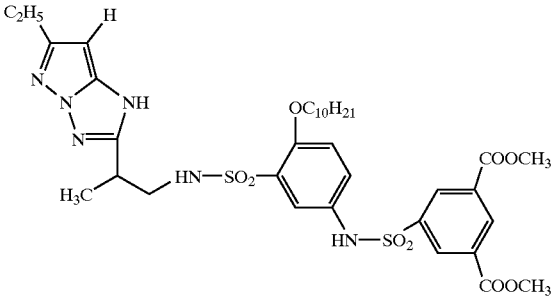

-continued
27
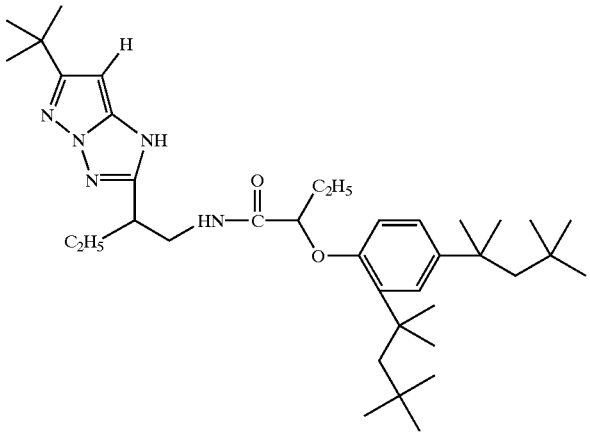
28
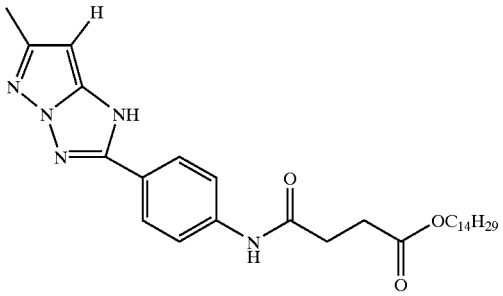
29
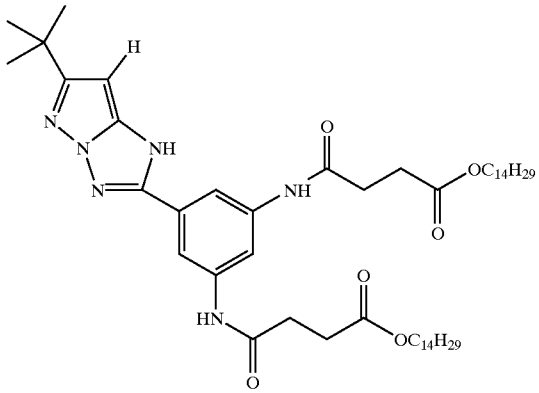
30
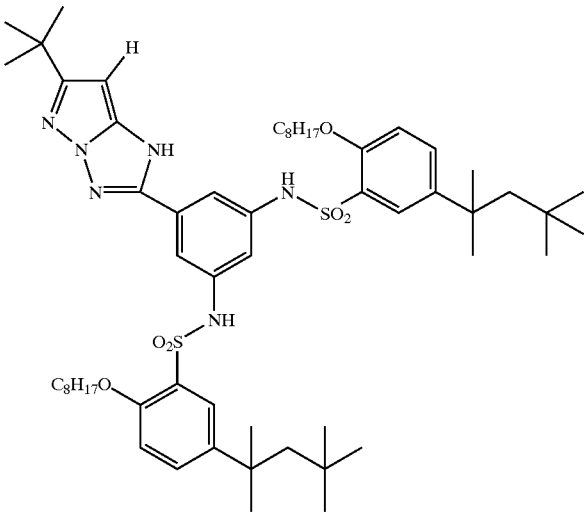
31
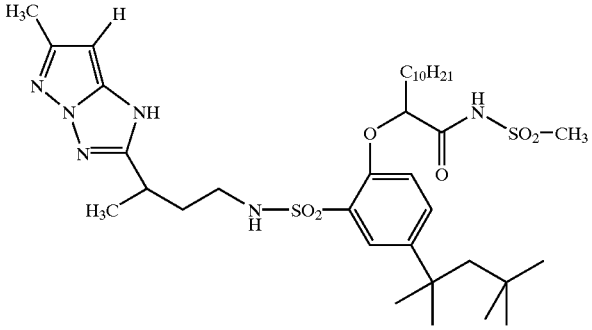
32
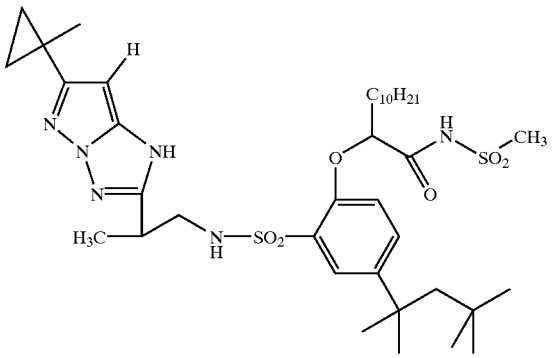

-continued
33
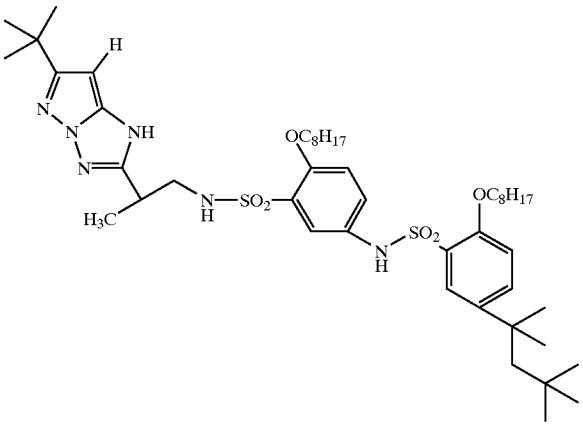
34
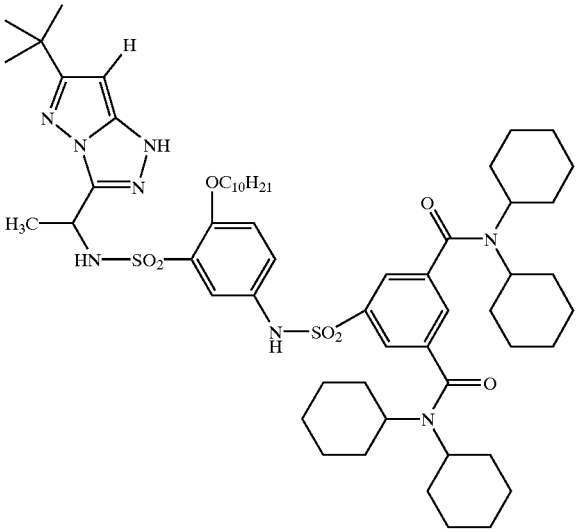
35
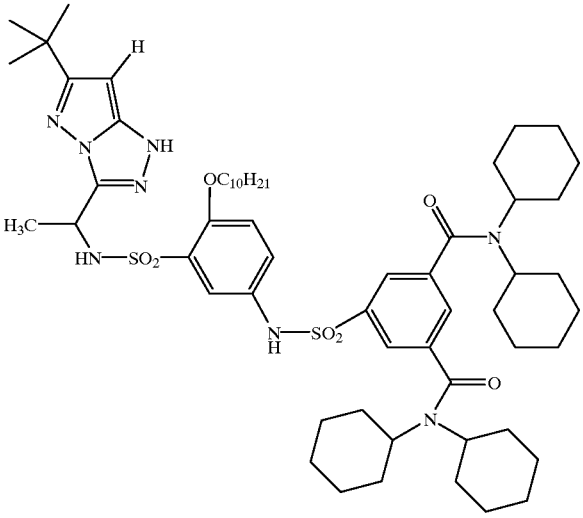
36
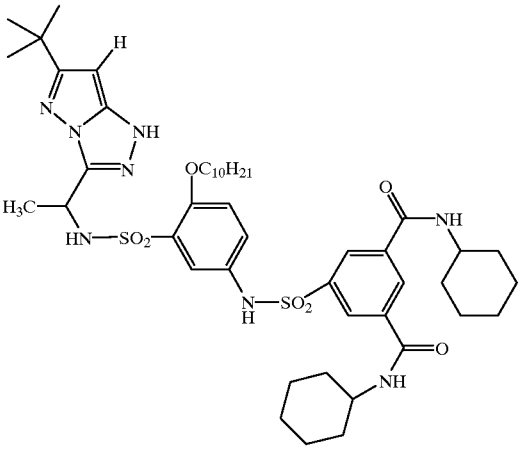
37
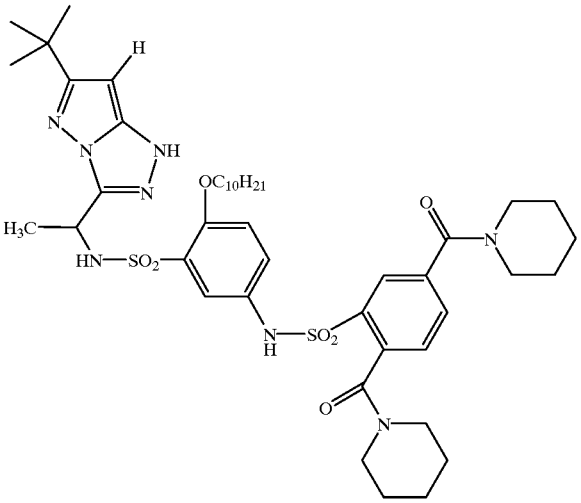
38
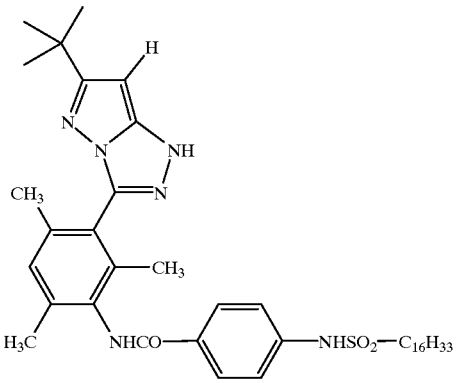

-continued

39

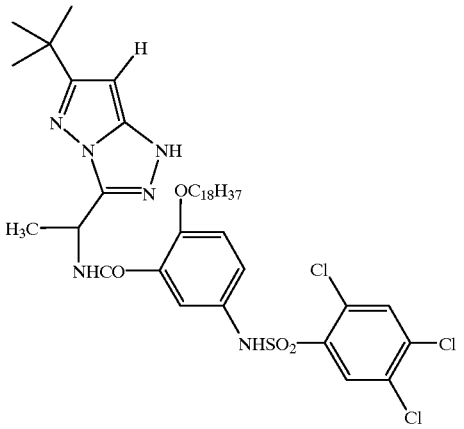

40

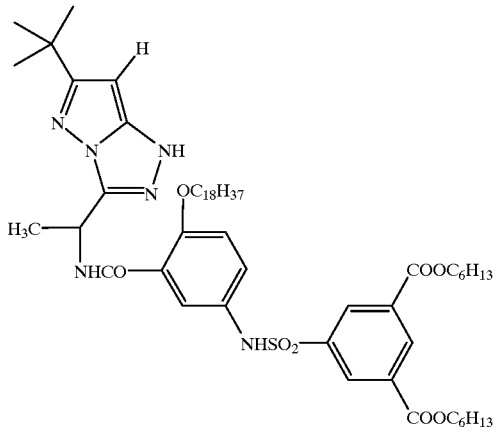

A coupler represented by formula (MC-1) of the present invention can be synthesized by known methods. Examples are described in U.S. Pat Nos. 4,540,654, 4,705,863, and 5,451,501, JP-A-61-65245, JP-A-62-209457, JP-A-62-249155, JP-A-63-41851, Jpn. Pat. Appln. KOKOKU Publication No. (hereinafter referred to as JP-B-)7-122744, JP-B-5-105682, JP-B-7-13309, JP-B-7-82252, U.S. Pat Nos. 3,725,067 and 4,777,121, JP-A-2-201442, JP-A-2-101077, JP-A-3-125143, and JP-A-4-242249, the disclosures of which are herein incorporated by reference.

A coupler of the present invention may be introduced to a light-sensitive material by various known dispersion methods. Of these methods, an oil-in-water dispersion method is favorable in which a coupler is dissolved in a high-boiling organic solvent (used in combination with a low-boiling solvent where necessary), the solution is dispersed by emulsification in an aqueous gelatin solution, and the dispersion is added to a silver halide emulsion. Examples of the high-boiling solvent used in this oil-in-water dispersion method are described in, e.g., U.S. Pat. No. 2,322,027, the disclosure of which is herein incorporated by reference. Practical examples of steps, effects, and impregnating latexes of a latex dispersion method as one polymer dispersion method are described in, e.g., U.S. Pat. No. 4,199,363, West German Patent Application (OLS) Nos. 2,541,274 and 2,541,230, JP-B-53-41091, and EP029104, the disclosures of which are herein incorporated by reference. Also, dispersion using an organic solvent-soluble polymer is described in PCT International Publication W088/00723, the disclosure of which is herein incorporated by reference.

Examples of the high-boiling solvent usable in the above-mentioned oil-in-water dispersion method are phthalic acid esters (e.g., dibutylphthalate, dioctylphthalate, dicyclohexylphthalate, bis(2-ethylhexyl)phthalate, decylphthalate, bis(2,4-di-tert-amylphenyl)isophthalate, and bis(1,1-diethylpropyl)phthalate), esters of phosphoric acid and phosphonic acid (e.g., diphenylphosphate, triphenylphosphate, tricresyl phosphate, 2-ethylhexyldiphenylphosphate, dioctylbutylphosphate, tricyclohexylphosphate, tri-2-ethylhexylphosphate, tridodecylphosphate, and bis(2-ethylhexyl) phenylphosphate), benzoic acid esters (e.g., 2-ethylhexylbenzoate, 2,4-dichlorobenzoate, dodecylbenzoate, and 2-ethylhexyl-p-hydroxybenzoate), amides (e.g., N,N-diethyldodecaneamide, N,N-diethyllaurylamide and N,N,N,N-tetrakis(2-ethylhexyl) isophthalic acid amide), alcohols and phenols (e.g., isostearylalcohol and 2,4-di-tert-amylphenol), aliphatic esters (e.g., dibutoxyethyl succinate, bis(2-ethylhexyl)succinate, 2-hexyldecyl tetradecanate, tributyl citrate, diethylazelate, isostearyllactate, and trioctyltosylate), aniline derivatives (e.g., N,N-dibutyl-2-butoxy-5-tert-octylaniline), chlorinated paraffins (paraffins containing 10% to 80% of chlorine), trimesic acid esters (e.g., trimesic acid tributyl), dodecylbenzene, diisopropylnaphthalene, phenols (e.g., 2,4-di-tert-amylphenol, 4-dodecyloxyphenol, 4-dodecyloxycarbonylphenol, and 4-(4-dodecyloxyphenylsulfonyl)phenol), carboxylic acids (e.g., 2-(2,4-di-tert-amylphenoxy butyric acid and 2-ethoxyoctanedecanic acid), alkylphosphoric acids (e.g., bis(2-ethylhexyl)phosphoric acid and diphenylphosphoric acid). In addition to the above high-boiling solvents, compounds described in, e.g., JP-A-6-258803, the disclosure of which is herein incorporated by reference, may also be preferably used as high-boiling solvents.

Of these solvents, phosphates of aliphatic alcohol, amides, and aliphatic esters are preferred, and the combinations of these solvents with alcohols or phenols are also preferred.

In the present invention, the ratio of the amount of a high-boiling organic solvent to that of a coupler of the present invention is preferably 0 to 2.0, more preferably, 0 to 1.0, and most preferably, 0 to 0.4, as a mass ratio.

If a large amount of tricresyl phosphate is used as a high-boiling organic solvent, the storage stability improving effect of the present invention reduces. Therefore, when tricresyl phosphate is to be used, the mass ratio of this tricresyl phosphate to a coupler of the present invention is preferably 0.4 or less, and more preferably, 0.2 or less.

As a co-solvent, it is also possible to use an organic solvent (e.g., ethyl acetate, butyl acetate, ethyl propionate, methylethylketone, cyclohexanone, 2-ethoxyethylacetate, and dimethylformamide) having a boiling point of 30° C. to about 160° C.

The content of a coupler of the present invention in a light-sensitive material is preferably 0.01 to 10 g, and more preferably, 0.1 g to 2 g per $m^2$. The content is appropriately $1\times10^{-3}$ to 1 mol, preferably $2\times10^{-3}$ to $3\times10^{-1}$ mol per mol of a silver halide in the same photosensitive emulsion layer.

When a photosensitive layer is a unit photosensitive layer (unit configuration) including two or more photosensitive emulsion layers differing in sensitivity, the content of a coupler of the present invention per mol of a silver halide is preferably $2\times10^{-3}$ to $1\times10^{-1}$ mol in a low-speed layer and $3\times10^{-2}$ to $3\times10^{-1}$ mol in a high-speed layer. When a unit photosensitive layer includes three photosensitive emulsion layers different in sensitivity, the content of a coupler of the present invention per mol of a silver halide is preferably $2\times10^{-3}$ to $1\times10^{-1}$ mol (more preferably $1\times10^{-2}$ to $1\times10^{-1}$ mol) in a low-speed layer, $1\times10^{-2}$ to $2\times10^{-1}$ mol (more preferably $3\times10^{-2}$ to $2\times10^{-1}$ mol) in a medium-speed layer, and $3\times10^{-2}$ to $3\times10^{-1}$ mol (more preferably $5\times10^{-2}$ to $2\times10^{-1}$ mol) in a high-speed layer.

Although the present invention contains a coupler represented by formula (MC-1), other couplers can also be used. However, the results become more preferable as the contribution of a color dye of a coupler of the present invention to the total density of dyes generating substantially the same color increases. More specifically, the amount is such that the contribution to the color generation density accounts for preferably 30% or more, more preferably, 50% or more, and most preferably, 70% or more, as a molar ratio.

A sensitive material of the present invention may also contain a competing compound (a compound which competes with an image forming coupler to react with an oxidized form of a color developing agent and which does not form any dye image). Examples of this competing coupler are reducing compounds such as hydroquinones, catechols, hydrazines, and sulfonamidophenols, and compounds which couple with an oxidized form of a color developing agent but do not substantially form a color image (e.g., colorless compound-forming couplers disclosed in German Patent No. 1,155,675, British Patent No. 861,138, and U.S. Pat. Nos. 3,876,428 and 3,912,513, and flow-out couplers disclosed in JP-A-6-83002, the disclosures of which are herein incorporated by reference).

The competing compound is preferably added to a sensitive emulsion layer containing a magenta coupler represented by formula (MC-1) of the present invention or a non-sensitive layer. The completing compound is particularly preferably added to a sensitive emulsion layer containing a coupler represented by formula (MC-1) of the present invention. The content of a competing compound is 0.01 to 10 g, preferably 0.10 to 5.0 g per $m^2$ of a sensitive material. The content is preferably 1 to 1,000 mol %, more preferably 20 to 500 mol % with respect to the coupler represented by formula (MC-1) of the present invention.

In a light-sensitive material of the present invention, a unit photosensitive layer including a plurality of color-sensitive layers sensitive to the same color may have a non-color-forming interlayer. Additionally, this interlayer preferably contains a compound selectable as the aforementioned competing compound.

To prevent deterioration of the photographic properties caused by formaldehyde gas, a light-sensitive material of the present invention preferably contains a compound described in U.S. Pat. No. 4,411,987 or 4,435,503, the disclosures of which are herein incorporated by reference, which may react with and fix formaldehyde gas.

A light-sensitive material of the present invention need only have at least one blue-sensitive silver halide emulsion layer, at least one green-sensitive silver halide emulsion layer, and at least one red-sensitive silver halide emulsion layer on a support. Although these layers are preferably formed by coating in this order from the one farthest from the support, different orders can also be used. Also, each color-sensitive layer is preferably a unit photosensitive layer (unit configuration) including two or more photosensitive emulsion layers differing in sensitivity. In particular, a three-layered unit configuration including three photosensitive emulsion layers, i.e., low-, medium-, and high-speed layers in this order from the one closest to the support is favored.

One preferred mode of the present invention is a photosensitive element in which a plastic support is coated with layers in the order of an undercoat layer/antihalation layer/first interlayer/unit red-sensitive emulsion layer (the order is a low-speed red-sensitive layer/medium-speed red-sensitive layer/high-speed red-sensitive layer from the one closest to the support)/second interlayer/unit green-sensitive emulsion layer (the order is a low-speed green-sensitive layer/medium-speed green-sensitive layer/high-speed green-sensitive layer from the one closest to the support)/third interlayer/yellow filter layer/unit blue-sensitive emulsion layer (the order is a low-speed blue-sensitive layer/medium-speed blue-sensitive layer/high-speed blue-sensitive layer from the one closest to the support)/first protective layer/second protective layer.

Each of the first, second, and third interlayers can be a single layer or two or more layers. The first interlayer is preferably divided into two or more layers, and the layer directly adjacent to the red-sensitive layer preferably contains yellow colloidal silver.

Likewise, the second interlayer preferably includes two or more layers, and the layer directly adjacent to the green-sensitive layer preferably contains yellow colloidal silver. In addition, a fourth interlayer is favorably formed between the yellow filter layer and the unit blue-sensitive emulsion layer.

Also, the protective layer preferably has a three-layered configuration including first to third protective layers. When the protective layer includes two or three layers, the second protective layer preferably contains a fine-grain silver halide having an average equivalent-sphere grain size of 0.10 $\mu$m or less. This silver halide is preferably silver bromide or silver iodobromide.

A support used in the present invention will be described below.

The thickness of a support used in the present invention is preferably 60 to 2,000 $\mu$m, and more preferably, 80 to 1,000 $\mu$m. When a light-sensitive material of the present invention is to be used as a so-called roll film (a Brownie film or 135 film), the thickness of the support is particularly preferably 80 to 150 $\mu$m. When a light-sensitive material of the present invention is to be used as a sheet film (e.g., a 4×5 film or 8×10 film), the thickness of the support is particularly preferably 150 to 300 $\mu$m. When only one surface is to be undercoated, the thickness of the transparent support is preferably 150 to 2,000 $\mu$m, and more preferably, 150 to 300 $\mu$m. When two surfaces are to be undercoated, the thickness is preferably 60 to 2,000 $\mu$m, more preferably, 80 to 500 $\mu$m, and most preferably, 80 to 150 $\mu$m.

A support used in the present invention is a transparent plastic support. Examples of preferred materials are cellulose acetate and polyester (e.g., polyethyleneterephthalate and polyethylenenaphthalate).

First, cellulose acetate will be explained. Cellulose acetate usable as a support of the present invention is favorably so-called triacetyl cellulose (to be also referred to as cellulose triacetate hereinafter) having an average acetylation degree of 58.0 to 62.5%. The acetylation degree means the bound acetic acid amount per unit mass of cellulose. This acetylation degree follows acetylation degree measurements and calculations in ASTM: D-817-91 (test methods for cellulose acetate and the like). As described above, this range of the cellulose acetate acetylation degree is a value required to meet the quality of a photographic support or an optical film.

A cellulose acetate film to be used as a support is manufactured using a solution as a dope in solvent casting. The dope is cast on a drum or band, and the solvent is evaporated to form a film. The density of the dope before casting is preferably so adjusted that the solid content is 18 to 35%. The surface of the drum or band is desirably mirror-finished. Casting and drying methods in solvent casting are described in U.S. Pat. Nos. 2,336,310, 2,367,603, 2,492,078, 2,492,977, 2,492,978, 2,607,704, 2,739,069, and 2,739,070, British Patents 640731 and 736892, JP-B-45-4554, JP-B-49-5614, JP-A-60-176834, JP-A-60-203430, and JP-A-62-115035, the disclosures of which are herein incorporated by reference.

A plasticizer can be added to a cellulose triacetate support in order to improve the mechanical physical properties or increase the drying speed. As this plasticizer, phosphate or carboxylate is used. Examples of phosphate include triphenyl phosphate (TPP) and tricresyl phosphate (TCP). Representative examples of carboxylate are phthalate and citrate. Examples of phthalate include dimethyl phthalate (DMP), diethyl phthalate (DEP), dibutyl phthalate (DBP), dioctyl phthalate (DOP), and diethylhexyl phthalate (DEHP). Examples of citrate include acetyltriethyl citrate (OACTE) and acetyltributyl citrate (OACTB). Other examples of carboxylate include butyl oleate, methylacetyl ricinoleate, dibutyl sebacate, and various trimellitates. Of these plasticizers, TPP and TCP are preferred.

The amount of the plasticizer is preferably 0.1 to 25 mass %, more preferably, 1 to 20 mass %, and most preferably, 3 to 15 mass % of the amount of cellulose acetate.

It is also possible to add deterioration inhibitors (e.g., a peroxide decomposer, radical inhibitor, metal inactivating agent, and acid capturing agent) and ultraviolet inhibitors. Deterioration inhibitors are described in JP-A-5-1907073, the disclosure of which is herein incorporated by reference. Ultraviolet inhibitors are described in JP-A-7-11056, the disclosure of which is herein incorporated by reference. Other properties of cellulose acetate favorable as a photographic support are described in JP-A-10-48779, the disclosure of which is herein incorporated by reference.

A polyester support will be described below.

Preferred examples of polyesters consisting of diol and dicarboxylic acid are homopolymers such as poly (ethyleneterephthalate), poly(ethylenenaphthalate), and poly (cyclohexanedimethanolterephthalate) (PCT). Particularly preferred examples are copolymers of 2,6-naphthalenedicarboxylic acid (NDCA), terephthalic acid (TPA), isophthalic acid (IPA), orthophthalic acid (OPA), and viphenyl-4,4'-dicarboxylic acid (PPDC), as aromatic dicarboxylic acid, ethylene glycol (EG), cyclohexanedimethanol (CHDM), neopentyl glycol (NPG), bisphenol A (BPA), and biphenol (BP), as diol, and parahydroxy benzoic acid (PHBA) and 6-hydroxy-2-naphthalene carboxylic acid (HNCA), as hydroxycarboxylic acid as a copolymerization component.

More preferred examples are a copolymer of terephthalic acid, naphthalenedicarboxylic acid, and ethylene glycol (the mixing molar ratio of terephthalic acid to naphthalenedicarboxylic acid is preferably 0.9:0.1 to 0.1:0.9, and more preferably, 0.8:0.2 to 0.2:0.8); a copolymer of terephthalic acid, ethylene glycol, and bisphenol A (the mixing molar ratio of ethylene glycol and bisphenol A is preferably 0.6:0.4 to 0:1.0, and more preferably, 0.5:0.5 to 0.1:0.9); a copolymer of isophthalic acid, biphenyl-4,4'-dicarboxylic acid, terephthalic acid, and ethylene glycol (the molar ratios of isophthalic acid and biphenyl-4,4'-dicarboxylic acid to terephthalic acid is preferably 0.1 to 0.5 and 0.1 to 0.5, and more preferably, 0.2 to 0.3 and 0.2 to 0.3, respectively); a copolymer of terephthalic acid, neopentyl glycol, and ethylene glycol (the molar ratio of neopentyl glycol to ethylene glycol is preferably 1:0 to 0.7:0.3, and more preferably, 0.9:0.1 to 0.6:0.4); a copolymer of terephthalic acid, ethylene glycol, and biphenol (the molar ratio of ethylene glycol to biphenyl is preferably 0:1.0 to 0.8:0.2, and more preferably, 0.1:0.9 to 0.7:0.3); and a copolymer of parahydroxy benzoic acid, ethylene glycol, and terephthalic acid (the molar ratio of parahydroxy benzoic acid to ethylene glycol is preferably 1:0 to 0.1:0.9, and more preferably, 0.9:0.1 to 0.2:0.8).

These homopolymers and copolymers can be synthesized in accordance with the conventionally known polyester manufacturing methods. For example, these polyesters can be synthesized by esterifying an acid component directly with a glycol component. When dialkyl ester is used as an acid component, polyesters can be synthesized by first allowing this acid component to cause an ester exchange reaction with a glycol component, and heating the resultant material under reduced pressure, thereby removing the excess glycol component. Alternatively, an acid component can be reacted, in the form of an acid halide, with glycol. In this reaction, an ester exchange reaction, catalyst, or polymerization reaction catalyst can be used or a heat-resistant stabilizing agent can be added as needed. These polyester synthesizing methods can be performed with reference to, e.g., Polymer Experimental Science Vol. 5, "Polycondensation and Polyaddition" (Kyoritsu Shuppan, 1980), pp. 103 to 136 and "Synthetic Polymer V" (Asakura Shoten, 1971), pp. 187 to 286, the disclosure of which is herein incorporated by reference. The average molecular weight (weight) of these polyesters is preferably about 10,000 to 500,000.

In addition, to improve the adhesion of any of these polyesters with respect to another type of polyester, the other polyester can be blended in the polyester, a monomer constructing the other polyester can be copolymerized with the polyester, or a monomer having an unsaturated bond can be copolymerized or radically crosslinked in these polyesters. A polymer blend formed by mixing two or more different polymers obtained as above can be easily molded in accordance with methods described in JP-A-49-5482, JP-A-64-4325, JP-A-3-192718, Research Disclosure Nos. 283,739-41, 284,779-82, and 294,807-14, the disclosures of which are herein incorporated by reference.

To further improve the functions as photographic supports, various additives are preferably used together with polyesters of the present invention. An ultraviolet absorbent can also be kneaded in these polyester films for the purposes of preventing fluorescence and giving aging stability. This ultraviolet absorbent desirably has no absorption in the visible region. The addition amount is usually 0.01 to 20 mass %, preferably about 0.05 to 10 wt % with respect to the mass of a polyester film. If the amount is less than 0.01 mass %, no effect of suppressing ultraviolet deterioration can be expected.

Examples of the ultraviolet absorbent are benzophenone-based ultraviolet absorbents such as
2,4-hydroxybenzophenone,
2-hydroxy-4-methoxybenzophenone,
2-hydroxy-4-n-octoxybenzophenone,
4-dodecyloxy-2-hydroxybenzophenone,
2,2',4,4'-tetrahydroxybenzophenone, and
2,2'-dihydroxy-4,4'-dimethoxybenzophenone;
benzotriazole-based ultraviolet absorbents such as
2(2'-hydroxy-5-methylphenyl)benzotriazole,
2(2'-hydroxy-3',5'-di-t-butylphenyl)benzotriazole, and 2-(2'-hydroxy-3'-di-t-butyl-5'-methylphenyl)benzotriazole; salicylic acid-based ultraviolet absorbents such as phenyl salicylate and methyl salicylate; and triazine-based ultraviolet absorbents such as 2,4,6-tris[2'-hydroxy-4'-(2"-ethylhexyloxy)phenyl]triaz ine and 2-phenyl-4,6-di[2'-hydroxy-4'-(2"-ethylhexyloxy) phenyltriazine.

A method of adding, e.g., inert inorganic grains to a polyester film, a method of adding dyes to a polyester film, and the like are known. In the present invention, the dye addition method which does not significantly increase film haze is favored. Dyes used in film dyeing are not particularly limited. However, gray dyeing is preferred in respect of color tone when the general properties of light-sensitive materials are taken into consideration. Also, dyes preferably have high heat resistance in the polyester film manufacturing temperature region and has high compatibility with polyester. From the above viewpoints, the purpose of the present invention can be achieved by mixing dyes, such as Diaresin manufactured by Mitsubishi Kasei Corp. and Kayaset manufactured by NIPPON KAYAKU CO., LTD., put on the market for use with polyester. The dyeing density must be preferably 0.01 or more, and more preferably, 0.03 or more, when the color density in the visible region is measured with a Macbeth color densitometer.

A polyester film of the present invention can also be given slip properties in accordance with the intended use. Although slip properties imparting means are not particularly restricted, the general approach is kneading of an inert inorganic compound or coating of a surfactant. Examples of inert inorganic grains are $SiO_2$, $TiO_2$, $BaSO_4$, $CaCO_3$, talc, and kaolin. In addition to slip properties impartment using an external grain system by which inert grains are added to the polyester synthetic reaction system described above, it is also possible to use a slip properties imparting method using an internal grain system by which an added catalyst or the like is precipitated during a polymerization reaction of polyester. These slip properties imparting means are not particularly limited. However, the transparency is an important factor of a support of a photographic light-sensitive material. As the above slip properties imparting means, therefore, it is desirable to select $SiO_2$ having a refractive index relatively close to that of a polyester film as the external grain system, or an internal grain system capable of relatively decreasing the grain size to be precipitated.

A plastic support of the present invention is surface-treated or undercoated to improve the adhesion between the support and a hydrophilic colloidal layer constructing a photosensitive element.

This is done by:

(1) A method of obtaining adhesion by direct coating of photographic emulsions after performing a surface activation treatment such as a chemical treatment, mechanical treatment, corona discharge treatment, flame treatment, ultraviolet treatment, high-frequency treatment, glow discharge treatment, active plasma treatment, laser treatment, mixed acid treatment, or ozone oxidation treatment; or (2) A method of forming an undercoat layer after performing any of these surface treatments, or without any such surface treatment, and coating this undercoat layer with photographic emulsion layers (e.g., U.S. Pat. Nos. 2,698,241, 2,764,520, 2,864,755, 3,462,335, 3,475,193, 3,143,421, 3,501,301, 3,460,944, and 3,674,531, British Patents 788,365, 804,005, and 891,469, JP-B-48-43122, and JP-B-51-446), the disclosures of which are herein incorporated by reference.

Any of these surface treatments probably more or less forms a polar group on the support surface which is originally hydrophobic, and increases the crosslinking density on the surface. This presumably increases the affinity for a polar group of a component contained in the undercoat solution or increases the fastness of the adhesion surface. Also, various improvements have been made for the arrangement of the undercoat layer. Examples are a so-called interlayer method and a single-layer method. In the former method, a layer (to be referred to as a first undercoat layer hereinafter) which adheres well to a support is formed as a first layer, and a hydrophilic resin layer (to be referred to as a second undercoat layer hereinafter) which is in good contact with a photographic layer is coated as a second layer on the first undercoat layer. In the latter method, only one resin layer including both hydrophobic and hydrophilic groups is coated.

Of the surface treatments described in (1), the corona discharge treatment can be accomplished by any conventionally known methods, e.g., methods disclosed in JP-B-48-5043, JP-B-47-51905, JP-A-47-20867, JP-A-49-83767, JP-A-51-41770, and JP-A-51-131576, the disclosures of which are herein incorporated by reference.

Also, the glow discharge treatment can be done by using any of conventionally known methods, e.g., JP-B-35-7578, JP-B-36-10336, JP-B-45-22004, JP-B-45-22005, JP-B-45-24040, JP-B-46-43480, U.S. Pat. Nos. 3,057,792, 3,057,795, 3,179,482, 3,288,638, 3,309,299, 3,424,735, 3,462,335, 3,475,307, and 3,761,299, British Patent 997,093, and JP-A-53-129262, the disclosures of which are herein incorporated by reference.

The undercoating method of the present invention will be described below.

In the present invention, at least one surface of the above-mentioned plastic support is coated with an undercoat solution. This undercoat solution of the present invention is characterized by containing at least one compound selected from a water-miscible organic solvent except for alcohols, substituted phenol having a molecular weight of 200 or less, and a substituted acetic acid in which at least one hydrogen atom on a methyl group of acetic acid is substituted by a halogen atom. The undercoat solution also contains a hydrophilic undercoat polymer which functions as an undercoat layer after drying. Examples of this hydrophilic undercoat polymer used in the present invention are a water-soluble polymer, cellulose ester, latex polymer, and water-soluble polyester. Examples of the water-soluble polyester are gelatin, a gelatin derivative, casein, agar-agar, soda alginate, starch, polyvinyl alcohol, a polyacrylic acid copolymer, and a maleic anhydride copolymer. Examples of the cellulose ester are carboxymethylcellulose and hydroxyethylcellulose. Examples of the latex polymer are a vinyl chloride-containing copolymer, vinylidene chloride-containing copolymer, acrylate-containing copolymer, vinyl acetate-containing copolymer, and butadiene-containing copolymer. Gelatin is most preferred in the present invention.

The compound used in the present invention, which is selected from a water-miscible organic solvent except for alcohols, substituted phenol having a molecular weight of 200 or less, and a substituted acetic acid in which at least one hydrogen atom on a methyl group of acetic acid is substituted by a halogen atom, has properties of being able to penetrate into the plastic consititutiing the support.

Examples of these compounds are as follows. Preferred examples of the water-miscible organic solvent except for alcohols are water-miscible ketones or aldehydes. Practical examples are acetone, formaldehyde, and chloral, and acetone is most preferred.

A "water-miscible organic solvent" mentioned in the present invention is an organic solvent which can be evenly mixed with pure water at a volume ratio of 50:50 at a temperature of 25° C.

Examples of the substituted phenol having a molecular weight of 200 or less are resorcin, chlororesorcin, methylresorcin, o-cresol, m-cresol, p-cresol, phenol, o-chlorophenol, p-chlorophenol, dichlorophenol, and trichlorophenol. The substituted phenol is favorably resorcin.

Examples of the acetic acid in which at least one hydrogen atom on a methyl group is substituted with a halogen atom are monochloroacetic acid, dichloroacetic acid, and trifluoroacetic acid.

The undercoat solution of the present invention preferably contains at least acetone, and more preferably, contains acetone and also contains at least one compound selected from substituted phenol having a molecular weight of 200 or less and acetic acid in which at least one hydrogen atom on a methyl group is substituted with a halogen atom.

A known gelatin hardener can be used in the undercoat layer of the present invention. Examples of this gelatin hardener are chromium salt (e.g., chrome alum), aldehydes (e.g., formaldehyde and glutaraldehyde), isocyanates, epichlorohydrin resin, cyanuric chloride-based compounds (e.g., compounds described in JP-B-47-6151, JP-B-47-33380, JP-B-54-25411, and JP-A-56-130740, the disclosures of which are herein incorporated by reference), vinylsulfone- or vinylsulfonyl-based compounds (e.g., compounds described in JP-B-47-24259, JP-B-50-35807, JP-A-49-24435, JP-A-53-41221, and JP-A-59-18944, the disclosures of which are herein incorporated by reference), carbamoyl ammonium salt-based compounds (e.g., compounds described in JP-B-56-12853, JP-B-58-32699, JP-A-49-51945, JP-A-51-59625, and JP-A-61-9641, the disclosures of which are herein incorporated by reference), amidinium salt-based compounds (e.g., compounds described in JP-A-60-225148, the disclosure of which is herein incorporated by reference), carbodiimide-based compounds (e.g., compounds described in JP-A-51-126125 and JP-A-52-48311, the disclosures of which are herein incorporated by reference), pyridinium salt-based compounds (e.g., compounds described in JP-B-58-50699, JP-A-52-54427, JP-A-57-44140, and JP-A-57-46538, the disclosures of which are herein incorporated by reference), and compounds described in Belgian Patent 825,726, U.S. Pat. No. 3,321,313, JP-A-50-38540, JP-A-52-93470, JP-A-56-43353, and JP-A-58-113929, the disclosures of which are herein incorporated by reference.

The undercoat layer of the present invention can contain fine inorganic or organic grains as a matting agent to such an extent that the transparency and graininess of images are not substantially impaired. As the inorganic fine-grain matting agent, silica ($SiO_2$), titanium dioxide ($TiO_2$), calcium carbonate, and magnesium carbonate can be used. As the organic fine-grain matting agent, it is possible to use polymethylmethacrylate, celluloseacetatepropionate, polystyrene, matting agents soluble in processing solutions described in U.S. Pat. No. 4,142,894, and polymers described in U.S. Pat. No. 4,396,706, the disclosures of which are herein incorporated by reference. The average grain size of these fine-grain matting agents is preferably 1 to 10 $\mu$m.

In addition, the undercoat layer can further contain various additives as needed. Examples are a surfactant, antistatic agent, antihalation agent, coloring dye, pigment, coating aid, and antifoggant.

The undercoat solution according to the present invention can be coated by any coating method well known to those skilled in the art, e.g., dip coating, air knife coating, curtain coating, roller coating, wire bar coating, gravure coating, or extrusion coating using a hopper described in U.S. Pat. No. 2,681,294, the disclosure of which is herein incorporated by reference. When desired, two or more layers can be simultaneously coated by methods described in, e.g., U.S. Pat. Nos. 2,761,791, 3,508,947, 2,941,898, and 3,526,528, and Yuji Harasaki, "Coating Engineering", page 253 (1973, issued by Asakura Shoten), the disclosures of which are herein incorporated by reference.

In the manufacture of a light-sensitive material according to the present invention, a silver halide photographic light-sensitive element is dried after coating. This drying is performed such that the acetone content in a light-sensitive material including a support, after the silver halide photographic light-sensitive element is coated and dried, is preferably 0.05% to 3.0%, and more preferably, 0.1% to 2.0%, as a mass ratio to the light-sensitive material. If drying is stronger than that, the brittleness of the support worsens. If the acetone content is larger than 3.0%, the influence on the photosensitive emulsion layers becomes too large.

In the present invention, a plastic support containing triacetyl cellulose as a main constituent and, as a plasticizer, containing at least one phosphate at a mass ratio of 3% to 15% with respect to the triacetyl cellulose, is preferably undercoated with an undercoat solution containing acetone, formalin, and gelatin. Also, a silver halide color photographic light-sensitive material is preferably manufactured by coating this support with a silver halide photographic light-sensitive element and drying the element such that the acetone content in the light-sensitive material including the support is 0.05% to 3.0% as a mass ratio to the light-sensitive material.

In silver halide photographic emulsions of the present invention and silver halide photographic light-sensitive materials using these emulsions, it is generally possible to use various techniques and inorganic and organic materials described in Research Disclosure Nos. 308119 (1989), 37038 (1995), and 40145 (1997), the disclosures of which are herein incorporated by reference.

In addition, techniques and inorganic and organic materials usable in color photographic light-sensitive materials to which silver halide photographic emulsions of the present invention can be applied are described in portions of EP436, 938A2 and patents cited below, the disclosures of which are herein incorporated by reference.

| Items | Corresponding portions |
|---|---|
| 1) Layer configurations | page 146, line 34 to page 147, line 25 |
| 2) Silver halide emulsions usable together | page 147, line 26 to page 148 line 12 |
| 3) Yellow couplers usable together | page 137, line 35 to page 146, line 33, and page 149, lines 21 to 23 |
| 4) Magenta couplers usable together | page 149, lines 24 to 28; EP421, 453A1, page 3, line 5 to page 25, line 55 |
| 5) Cyan couplers usable together | page 149, lines 29 to 33; EP432, 804A2, page 3, line 28 to page 40, line 2 |
| 6) Polymer couplers | page 149, lines 34 to 38; EP435, 334A2, page 113, line 39 to page 123, line 37 |

-continued

| Items | Corresponding portions |
|---|---|
| 7) Colored couplers | page 53, line 42 to page 137, line 34, and page 149, lines 39 to 45 |
| 8) Functional couplers usable together | page 7, line 1 to page 53, line 41, and page 149, line 46 to page 150, line 3; EP435, 334A2, page 3, line 1 to page 29, line 50 |
| 9) Antiseptic and mildewproofing agents | page 150, lines 25 to 28 |
| 10) Formalin scavengers | page 149, lines 15 to 17 |
| 11) Other additives usable together | page 153, lines 38 to 47; EP421, 453A1, page 75, line 21 to page 84, line 56, and page 27, line 40 to page 37, line 40 |
| 12) Dispersion methods | page 150, lines 4 to 24 |
| 13) Supports | page 150, lines 32 to 34 |
| 14) Film thickness · film physical properties | page 150, lines 35 to 49 |
| 15) Color development step | page 150, line 50 to page 151, line 47 |
| 16) Desilvering step | page 151, line 48 to page 152, line 53 |
| 17) Automatic processor | page 152, line 54 to page 153, line 2 |
| 18) Washing · stabilizing step | page 153, lines 3 to 37 |

EXAMPLE-1

The present invention will be described in detail below by way of its examples. However, the present invention is not limited to these examples.

Formation of Sample 101

(i) Formation of triacetyl cellulose films

Triacetyl cellulose was dissolved (13% as a mass) in dichloromethane/methanol=92/8 (mass ratio) by normal solvent casting, and triphenyl phosphate and biphenyldiphenyl phosphate as plasticizers were added at a mass ratio of 2:1 such that the total amount was 14% with respect to the triacetyl cellulose, thereby forming a film by a band method. By using the same manufacturing method, films having thicknesses shown in Table 1 to be presented later were formed.

(ii) Contents of undercoat layer

Each of the above triacetyl cellulose films was coated with an undercoat solution having the following composition. Each number represents a mass contained per liter (to be referred to as L hereinafter) of the undercoat solution. (Undercoating A).

Before this undercoating was performed, the two surfaces of each film were subjected to a corona discharge treatment.

| | |
|---|---|
| Gelatin | 10.0 g |
| Salicylic acid | 0.5 g |
| Glycerin | 4.0 g |
| Acetone | 700 milliliters (to be referred to as mL hereinafter) |
| Methanol | 200 mL |
| Dichloromethane | 80 mL |
| Formaldehyde | 0.1 mg |
| Water to make | 1.0 L |

The triacetyl cellulose supports were coated with the above undercoat solution as shown in Table 1, thereby forming bases A to H. That is, the coating solution was coated in an amount of 50 mL per $m^2$ of the support and dried for 2 min by warm air at a temperature of 35° C. and a humidity of 50%. Subsequently, the resultant material was exposed to dried air at 100° C. for 20 sec and wound at a controlled temperature of 25° C. After that, photosensitive emulsion layers were coated.

Also, as (undercoating B), acetone and formaldehyde in undercoating A were replaced with an equivalent mass of methanol to perform undercoating as a comparative example.

Furthermore, (undercoating C) was performed by adding 5.0 g of resorcin per L in (undercoating A).

TABLE 1

| Base | Plastic thickness | Photosensitive emulsion coated surface | Back surface |
|---|---|---|---|
| A | 127 μm | Undercoating A | No undercoating |
| B | 127 μm | Undercoating A | Undercoating A |
| C | 127 μm | Undercoating A (twofold amount) | No undercoating |
| D | 98 μm | Undercoating A | Undercoating A |
| E | 205 μm | Undercoating A | No undercoating |
| F | 205 μm | Undercoating A | Undercoating A |
| G | 205 μm | Undercoating B | Undercoating B |
| H | 205 μm | Undercoating C | Undercoating A |

The bases A to H formed as above were coated with photosensitive emulsion layers and, where necessary, coated with a back layer.

A multilayered color light-sensitive material including layers having the following compositions was formed on the side indicated as a photosensitive emulsion coated surface in Table 1. Sample 101 was formed using the base A, and samples 102 to 108 were formed using the bases B to H in this order. Each number represents the addition amount per $m^2$. Note that the effects of added compounds are not restricted to the described purposes.

Note also that the undercoat layer of the back surface of the base D was coated with back layers described below.

| | |
|---|---|
| 1st layer Binder: acid-processed gelatin (isoelectric point 9.0) | 1.00 g |
| Polymer latex: B-1 (average grain size 0.1 μm) | 0.13 g |
| Polymer latex: B-2 (average grain size 0.2 μm) | 0.23 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-3 | 0.010 g |
| Surfactant W-6 | 3.0 mg |
| 2nd layer Binder: acid-processed gelatin (isoelectric point 9.0) | 3.10 g |
| Polymer latex: B-2 (average grain size 0.2 μm) | 0.11 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-3 | 0.010 g |
| Surfactant W-6 | 3.0 mg |
| Dye D-2 | 0.10 g |
| Dye D-10 | 0.12 g |
| Potassium sulfate | 0.25 g |
| Sodium hydroxide | 0.03 g |
| 3rd layer Binder: acid-processed gelatin (isoelectric point 9.0) | 3.30 g |
| Surfactant W-3 | 0.020 g |

-continued

| | |
|---|---|
| Potassium sulfate | 0.30 g |
| Sodium hydroxide | 0.03 g |
| 4th layer Binder: lime-processed gelatin | 1.15 g |
| 1:9 copolymer of methacrylic acid and methylmethacrylate (average grain size 2.0 μm) | 0.040 g |
| 6:4 copolymer of methacrylic acid and methylmethacrylate (average grain size 2.0 μm) | 0.030 g |
| Surfactant W-3 | 0.060 g |
| Surfactant W-2 | 7.0 mg |
| Hardener H-1 | 0.23 g |

The bases E, F, G, and H were coated with back layers described below.

| | |
|---|---|
| 1st layer Binder: acid-processed gelatin (isoelectric point 9.0) | 0.70 g |
| Polymer latex: B-1 (average grain size 0.1 μm) | 0.080 g |
| Polymer latex: B-2 (average grain size 0.2 μm) | 0.15 g |
| Ultraviolet absorbent U-1 | 0.020 g |
| Ultraviolet absorbent U-3 | 0.010 g |
| Ultraviolet absorbent U-4 | 0.010 g |
| High-boiling organic solvent Oil-2 | 0.020 g |
| Surfactant W-3 | 0.010 g |
| Surfactant W-6 | 3.0 mg |
| 2nd layer Binder: acid-processed gelatin (isoelectric point 9.0) | 5.50 g |
| Polymer latex: B-2 (average grain size 0.2 μm) | 0.20 g |
| Ultraviolet absorbent U-1 | 0.050 g |
| Ultraviolet absorbent U-3 | 0.010 g |
| Ultraviolet absorbent U-4 | 0.030 g |
| High-boiling organic solvent Oil-2 | 0.050 g |
| Surfactant W-3 | 0.030 g |
| Surfactant W-6 | 5.0 mg |
| Potassium sulfate | 0.50 g |
| Sodium hydroxide | 0.070 g |
| 3rd layer Binder: acid-processed gelatin (isoelectric point 9.0) | 5.00 g |
| Surfactant W-3 | 0.020 g |
| Potassium sulfate | 0.40 g |
| Sodium hydroxide | 0.07 g |
| 4th layer Binder: lime-processed gelatin | 0.80 g |
| 1:9 copolymer of methacrylic acid and methylmethacrylate (average grain size 2.0 μm) | 0.020 g |
| 6:4 copolymer of methacrylic acid and methylmethacrylate (average grain size 2.0 μm) | 0.020 g |
| Surfactant W-3 | 0.030 g |
| Surfactant W-2 | 4.0 mg |
| Hardener H-1 | 0.35 g |

The photosensitive emulsion surfaces of the bases A to H were coated with the following layers.

| 1st layer: Antihalation layer | |
|---|---|
| Black colloidal silver | 0.20 g |
| Gelatin | 2.00 g |
| Ultraviolet absorbent U-1 | 0.10 g |
| Ultraviolet absorbent U-3 | 0.10 g |
| Ultraviolet absorbent U-4 | 0.10 g |
| High-boiling organic solvent Oil-1 | 0.050 g |
| High-boiling organic solvent Oil-2 | 0.050 g |
| Dye D-4 | 1.0 mg |

-continued

| | |
|---|---|
| Dye D-8 | 2.5 mg |
| Fine-crystal solid dispersion of dye E-1 | 0.05 g |

| 2nd layer: Interlayer | |
|---|---|
| Gelatin | 0.50 g |
| Compound Cpd-A | 0.2 mg |
| Compound Cpd-K | 3.0 mg |
| Compound Cpd-M | 0.030 g |
| Ultraviolet absorbent U-6 | 6.0 mg |
| High-boiling organic solvent Oil-3 | 0.010 g |
| High-boiling organic solvent Oil-4 | 0.010 g |
| High-boiling organic solvent Oil-7 | 2.0 mg |
| High-boiling organic solvent Oil-8 | 5.0 mg |
| Dye D-7 | 4.0 mg |

| 3rd layer: Interlayer | | |
|---|---|---|
| Yellow colloidal silver | silver | 0.020 g |
| Gelatin | | 0.60 g |
| Compound Cpd-M | | 0.010 g |
| Compound Cpd-D | | 0.020 g |
| High-boiling organic solvent Oil-3 | | 0.010 g |

| 4th layer: Low-speed red-sensitive emulsion layer | | |
|---|---|---|
| Emulsion A | silver | 0.10 g |
| Emulsion B | silver | 0.20 g |
| Emulsion C | silver | 0.20 g |
| Gelatin | | 0.70 g |
| Coupler C-1 | | 0.030 g |
| Coupler C-2 | | 0.070 g |
| Coupler C-6 | | 6.0 mg |
| Coupler C-9 | | 5.0 mg |
| Coupler C-11 | | 0.020 g |
| Ultraviolet absorbent U-3 | | 0.010 g |
| Compound Cpd-A | | 1.0 mg |
| Compound Cpd-I | | 0.020 g |
| Compound Cpd-J | | 2.0 mg |
| High-boiling organic solvent Oil-2 | | 0.050 g |
| Additive P-1 | | 0.020 g |

| 5th layer: Medium-speed red-sensitive emulsion layer | | |
|---|---|---|
| Emulsion C | silver | 0.20 g |
| Emulsion D | silver | 0.25 g |
| Gelatin | | 0.70 g |
| Coupler C-1 | | 0.10 g |
| Coupler C-2 | | 0.040 g |
| Coupler C-3 | | 0.010 g |
| Coupler C-6 | | 7.0 mg |
| Coupler C-11 | | 0.030 g |
| Ultraviolet absorbent U-3 | | 0.010 g |
| High-boiling organic solvent Oil-2 | | 0.070 g |
| Additive P-1 | | 0.020 g |

| 6th layer: High-speed red-sensitive emulsion layer | | |
|---|---|---|
| Emulsion E | silver | 0.20 g |
| Emulsion F | silver | 0.20 g |
| Gelatin | | 1.70 g |
| Coupler C-1 | | 0.020 g |
| Coupler C-2 | | 0.010 g |
| Coupler C-3 | | 0.60 g |
| Coupler C-6 | | 0.010 g |
| Coupler C-11 | | 0.20 g |
| Ultraviolet absorbent U-1 | | 0.010 g |
| Ultraviolet absorbent U-2 | | 0.010 g |
| High-boiling organic solvent Oil-2 | | 0.030 g |
| High-boiling organic solvent Oil-9 | | 0.010 g |
| Compound Cpd-D | | 5.0 mg |
| Compound Cpd-K | | 1.0 mg |
| Compound Cpd-L | | 1.0 mg |
| Compound Cpd-F | | 0.030 g |
| Additive P-1 | | 0.10 g |

| 7th layer: Interlayer | |
|---|---|
| Gelatin | 1.00 g |
| Additive P-2 | 0.10 g |
| Compound Cpd-I | 0.010 g |
| Dye D-5 | 0.020 g |
| Dye D-9 | 6.0 mg |
| Compound Cpd-M | 0.040 g |

-continued

| | | | |
|---|---|---|---|
| Compound Cpd-O | | 3.0 | mg |
| Compound Cpd-P | | 5.0 | mg |
| High-boiling organic solvent Oil-6 | | 0.050 | g |

8th layer: Interlayer

| | | | |
|---|---|---|---|
| Yellow colloidal silver | silver | 0.020 | g |
| Gelatin | | 1.20 | g |
| Additive P-2 | | 0.05 | g |
| Ultraviolet absorbent U-1 | | 0.010 | g |
| Ultraviolet absorbent U-3 | | 0.010 | g |
| Compound Cpd-A | | 0.050 | g |
| Compound Cpd-D | | 0.030 | g |
| Compound Cpd-M | | 0.050 | g |
| High-boiling organic solvent Oil-3 | | 0.010 | g |
| High-boiling organic solvent Oil-6 | | 0.050 | g |

9th layer: Low-speed green-sensitive emulsion layer

| | | | |
|---|---|---|---|
| Emulsion G | silver | 0.20 | g |
| Emulsion H | silver | 0.35 | g |
| Emulsion I | silver | 0.30 | g |
| Gelatin | | 1.50 | g |
| Coupler C-7 | | 0.13 | g |
| Coupler C-8 | | 0.070 | g |
| Coupler C-12 | | 0.010 | g |
| Compound Cpd-B | | 0.030 | g |
| Compound Cpd-D | | 5.0 | mg |
| Compound Cpd-E | | 5.0 | mg |
| Compound Cpd-G | | 2.5 | mg |
| Compound Cpd-F | | 0.010 | g |
| Compound Cpd-K | | 2.0 | mg |
| Ultraviolet absorbent U-6 | | 5.0 | mg |
| High-boiling organic solvent Oil-2 | | 0.10 | g |
| High-boiling organic solvent Oil-6 | | 0.030 | g |
| High-boiling organic solvent Oil-4 | | 8.0 | mg |
| Additive P-1 | | 5.0 | mg |

10th layer: Medium-speed green-sensitive emulsion layer

| | | | |
|---|---|---|---|
| Emulsion I | silver | 0.20 | g |
| Emulsion J | silver | 0.30 | g |
| Internally fogged silver bromide emulsion (cubic, average equivalent-sphere grain size 0.11 μm) | silver | 5.0 | mg |
| Gelatin | | 0.70 | g |
| Coupler C-4 | | 0.40 | g |
| Coupler C-8 | | 0.020 | g |
| Coupler C-12 | | 0.010 | g |
| Compound Cpd-B | | 0.030 | g |
| Compound Cpd-F | | 0.010 | g |
| Compound Cpd-G | | 2.0 | mg |
| High-boiling organic solvent Oil-2 | | 0.050 | g |
| High-boiling organic solvent Oil-5 | | 6.0 | mg |

11th layer: High-speed green-sensitive emulsion layer

| | | | |
|---|---|---|---|
| Emulsion K | silver | 0.65 | g |
| Gelatin | | 0.70 | g |
| Coupler C-3 | | 5.0 | mg |
| Coupler C-4 | | 0.50 | g |
| Coupler C-8 | | 0.010 | g |
| Compound Cpd-B | | 0.050 | g |
| Compound Cpd-F | | 0.010 | g |
| Compound Cpd-K | | 2.0 | mg |
| High-boiling organic solvent Oil-2 | | 0.050 | g |

12th layer: Interlayer

| | | | |
|---|---|---|---|
| Gelatin | | 0.50 | g |
| Compound Cpd-M | | 0.05 | g |
| High-boiling organic solvent Oil-3 | | 0.025 | g |
| High-boiling organic solvent Oil-6 | | 0.025 | g |
| Dye D-6 | | 5.0 | mg |

13th layer: Yellow filter layer

| | | | |
|---|---|---|---|
| Yellow colloidal silver | silver | 0.030 | g |
| Gelatin | | 1.00 | g |
| Compound Cpd-C | | 0.010 | g |
| Compound Cpd-M | | 0.030 | g |
| High-boiling organic solvent Oil-1 | | 0.020 | g |
| High-boiling organic solvent Oil-6 | | 0.030 | g |
| Fine-crystal solid dispersion of dye E-2 | | 0.030 | g |

-continued

14th layer: Interlayer

| | | | |
|---|---|---|---|
| Gelatin | | 0.40 | g |
| Compound Cpd-Q | | 0.20 | g |

15th layer: Low-speed blue-sensitive emulsion layer

| | | | |
|---|---|---|---|
| Emulsion L | silver | 0.30 | g |
| Emulsion M | silver | 0.20 | g |
| Gelatin | | 0.80 | g |
| Coupler C-5 | | 0.020 | g |
| Coupler C-6 | | 5.0 | mg |
| Coupler C-10 | | 0.30 | g |
| Compound Cpd-B | | 0.10 | g |
| Compound Cpd-I | | 8.0 | mg |
| Compound Cpd-K | | 1.0 | mg |
| Compound Cpd-M | | 0.010 | g |
| Ultraviolet absorbent U-6 | | 0.010 | g |
| High-boiling organic solvent Oil-2 | | 0.010 | g |

16th layer: Medium-speed blue-sensitive emulsion layer

| | | | |
|---|---|---|---|
| Emulsion N | silver | 0.20 | g |
| Emulsion O | silver | 0.20 | g |
| Internally fogged silver bromide emulsion (cubic, average equivalent-sphere grain size 0.11 μm) | silver | 3.0 | mg |
| Gelatin | | 0.90 | g |
| Coupler C-5 | | 0.020 | g |
| Coupler C-6 | | 0.010 | g |
| Coupler C-10 | | 0.25 | g |
| Compound Cpd-B | | 0.10 | g |
| Compound Cpd-N | | 2.0 | mg |
| High-boiling organic solvent Oil-2 | | 0.010 | g |

17th layer: High-speed blue-sensitive emulsion layer

| | | | |
|---|---|---|---|
| Emulsion O | silver | 0.20 | g |
| Emulsion P | silver | 0.25 | g |
| Gelatin | | 2.00 | g |
| Coupler C-3 | | 5.0 | mg |
| Coupler C-5 | | 0.10 | g |
| Coupler C-6 | | 0.020 | g |
| Coupler C-10 | | 1.00 | g |
| High-boiling organic solvent Oil-2 | | 0.10 | g |
| High-boiling organic solvent Oil-6 | | 0.020 | g |
| Ultraviolet absorbent U-6 | | 0.10 | g |
| Compound Cpd-B | | 0.20 | g |
| Compound Cpd-N | | 5.0 | mg |

18th layer: 1st protective layer

| | | | |
|---|---|---|---|
| Gelatin | | 0.80 | g |
| Ultraviolet absorbent U-1 | | 0.15 | g |
| Ultraviolet absorbent U-2 | | 0.050 | g |
| Ultraviolet absorbent U-5 | | 0.20 | g |
| Compound Cpd-O | | 5.0 | mg |
| Compound Cpd-A | | 0.030 | g |
| Compound Cpd-H | | 0.20 | g |
| Dye D-1 | | 8.0 | mg |
| Dye D-2 | | 0.010 | g |
| Dye D-3 | | 0.010 | g |
| High-boiling organic solvent Oil-3 | | 0.10 | g |

19th layer: 2nd protective layer

| | | | |
|---|---|---|---|
| Colloidal silver | silver | 3.0 | mg |
| Fine-grain silver iodobromide emulsion (average grain size 0.06 μm, AgI content 1 mol %) | silver | 0.10 | g |
| Gelatin | | 0.80 | g |
| Ultraviolet absorbent U-1 | | 0.010 | g |
| Ultraviolet absorbent U-6 | | 0.010 | g |
| High-boiling organic solvent Oil-3 | | 0.010 | g |

20th layer: 3rd protective layer

| | | | |
|---|---|---|---|
| Gelatin | | 1.20 | g |
| Polymethylmethacrylate (average grain size 1.5 μm) | | 0.10 | g |
| 6:4 copolymer of methylmethacrylate and methacrylic acid (average grain size 1.5 μm) | | 0.15 | g |
| Silicone oil SO-1 | | 0.20 | g |
| Surfactant W-1 | | 3.0 | mg |

-continued

| | |
|---|---|
| Surfactant W-2 | 8.0 mg |
| Surfactant W-3 | 0.040 g |
| Surfactant W-7 | 0.015 g |

In addition to the above compositions, additives F-1 to F-8 were added to all emulsion layers. Also, a gelatin hardener H-1 and surfactants W-3, W-4, W-5, and W-6 for coating and emulsification were added to each layer.

Furthermore, phenol, 1,2-benzisothiazoline-3-one, 2-phenoxyethanol, phenethylalcohol, and p-benzoic butylester were added as antiseptic and mildewproofing agents.

TABLE 2

Emulsions used in sample 101

| Emulsion | Characteristics | Average equivalent-sphere grain size (μm) | Variation coefficient (%) | AgI content (%) |
|---|---|---|---|---|
| A | Monodisperse tetradecahedral grain | 0.13 | 10 | 4.5 |
| B | Monodisperse (111) internal latent image type tabular grain Average aspect ratio 2.0 | 0.25 | 15 | 4.8 |
| C | Monodisperse (111) tabular grain Average aspect ratio 2.0 | 0.32 | 15 | 4.5 |
| D | Monodisperse (111) tabular grain Average aspect ratio 3.0 | 0.40 | 12 | 4.8 |
| E | Monodisperse (111) tabular grain Average aspect ratio 3.5 | 0.50 | 12 | 2.0 |
| F | Monodisperse (111) tabular grain Average aspect ratio 5.0 | 0.55 | 12 | 1.8 |
| G | Monodisperse cubic grain | 0.17 | 10 | 4.5 |
| H | Monodisperse cubic internal latent image type grain | 0.24 | 10 | 4.0 |
| I | Monodisperse (111) tabular grain Average aspect ratio 4.0 | 0.32 | 15 | 3.5 |
| J | Monodisperse (111) tabular grain Average aspect ratio 5.0 | 0.45 | 10 | 3.0 |
| K | Monodisperse (111) tabular grain Average aspect ratio 6.5 | 0.58 | 13 | 2.5 |
| L | Monodisperse tetradecahedral grain | 0.33 | 10 | 4.5 |
| M | Monodisperse (111) tabular grain Average aspect ratio 3.0 | 0.33 | 9 | 6.0 |
| N | Monodisperse (111) tabular grain Average aspect ratio 3.0 | 0.43 | 10 | 2.5 |
| O | Monodisperse (111) tabular grain Average aspect ratio 7.0 | 0.70 | 10 | 3.0 |
| P | Monodisperse (111) tabular grain Average aspect ratio 7.0 | 0.90 | 10 | 2.8 |

TABLE 3

Spectral sensitization of emulsions A–P

| Emulsion | Added sensitizing dye | Addition amount (g) per mol of silver halide |
|---|---|---|
| A | S-1 | 0.01 |
| | S-2 | 0.20 |
| | S-3 | 0.02 |
| | S-8 | 0.25 |
| | S-13 | 0.015 |
| | S-14 | 0.01 |
| B | S-2 | 0.20 |
| | S-3 | 0.02 |
| | S-8 | 0.20 |
| | S-13 | 0.015 |
| | S-14 | 0.01 |
| C | S-2 | 0.25 |
| | S-3 | 0.04 |
| | S-8 | 0.25 |
| | S-13 | 0.02 |
| | S-14 | 0.04 |
| D | S-2 | 0.25 |
| | S-3 | 0.03 |
| | S-8 | 0.25 |
| | S-13 | 0.01 |
| E | S-1 | 0.01 |
| | S-2 | 0.20 |
| | S-3 | 0.05 |
| | S-8 | 0.25 |
| | S-13 | 0.01 |
| | S-14 | 0.02 |
| F | S-2 | 0.20 |
| | S-3 | 0.04 |
| | S-8 | 0.20 |
| | S-14 | 0.02 |
| G | S-4 | 0.3 |
| | S-5 | 0.05 |
| | S-12 | 0.1 |
| H | S-4 | 0.2 |
| | S-5 | 0.05 |
| | S-9 | 0.15 |
| | S-14 | 0.02 |
| I | S-4 | 0.3 |
| | S-9 | 0.2 |
| | S-12 | 0.1 |

TABLE 4

Spectral sensitization of emulsions A–P (continued from Table 3)

| Emulsion | Added sensitizing dye | Addition amount (g) per mol of silver halide |
|---|---|---|
| J | S-4 | 0.35 |
| | S-5 | 0.05 |
| | S-12 | 0.1 |
| K | S-4 | 0.3 |
| | S-9 | 0.05 |
| | S-12 | 0.1 |
| | S-14 | 0.02 |
| L | S-6 | 0.1 |
| | S-10 | 0.2 |
| | S-11 | 0.05 |
| M | S-6 | 0.05 |
| | S-7 | 0.05 |
| | S-10 | 0.25 |
| | S-11 | 0.05 |
| N | S-10 | 0.4 |
| | S-11 | 0.15 |
| O | S-6 | 0.05 |
| | S-7 | 0.05 |
| | S-10 | 0.3 |
| | S-11 | 0.1 |

TABLE 4-continued
Spectral sensitization of emulsions A–P (continued from Table 3)
| Emulsion | Added sensitizing dye | Addition amount (g) per mol of silver halide |
|---|---|---|
| P | S-6 | 0.05 |
| | S-7 | 0.05 |
| | S-10 | 0.2 |
| | S-11 | 0.25 |
C-1
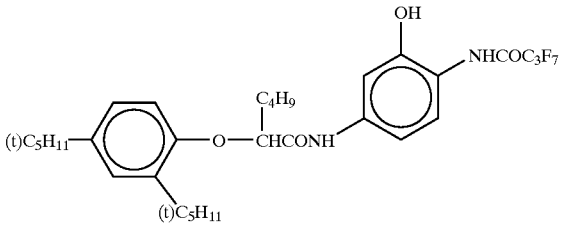
C-2
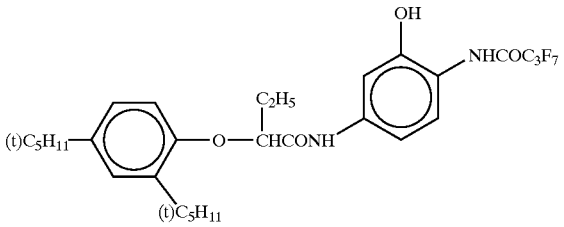
C-3
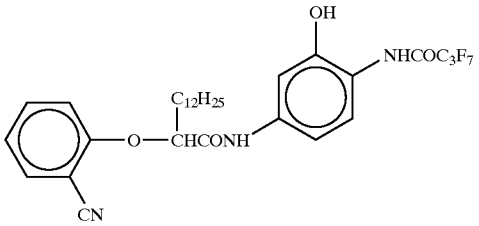
C-4
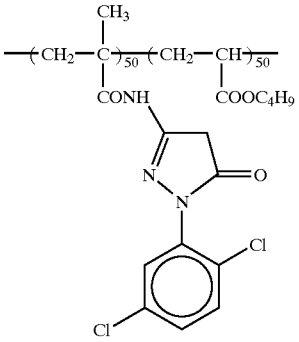
Figure indicates mass %
Average molecular weight: about 25,000
-continued
C-5
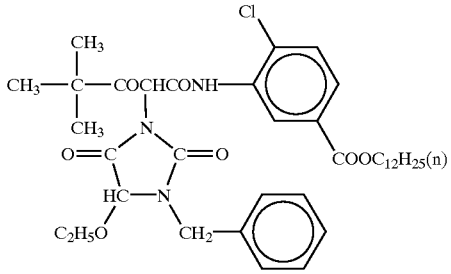
C-6
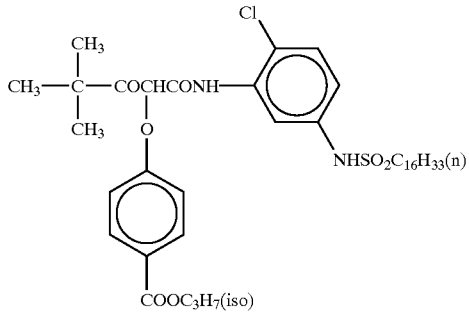
C-7
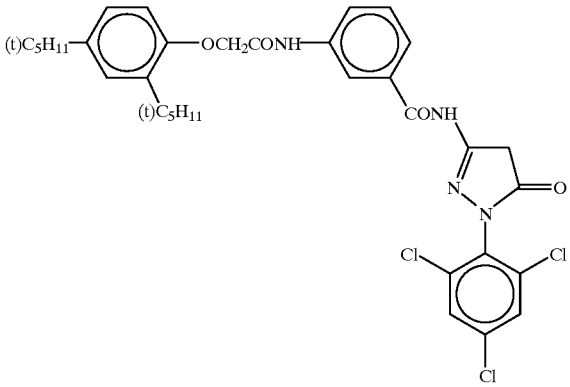
C-8
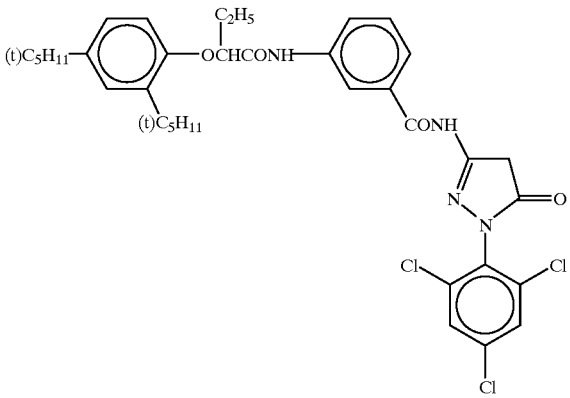

C-9
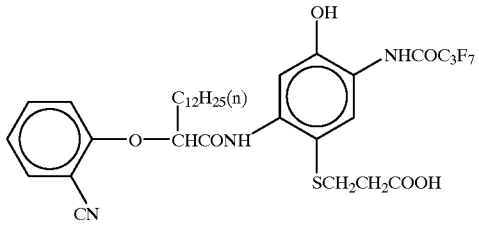
C-10
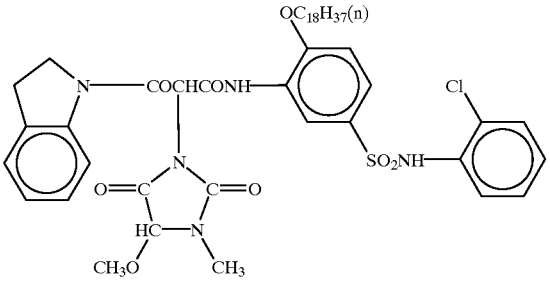
C-11
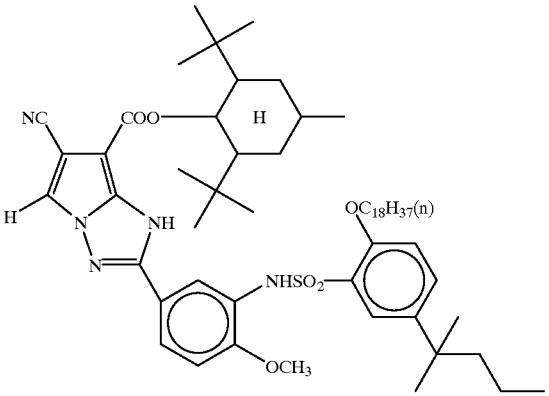
C-12
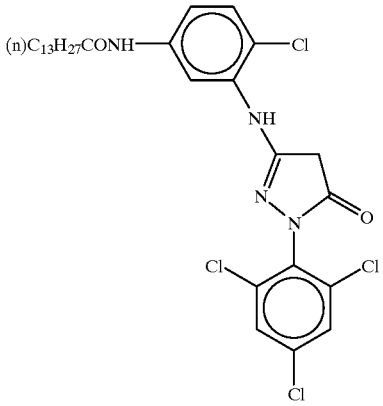
Oil-1 tri-n-hexyl phosphate
Oil-2 tricresyl phosphate
Oil-3
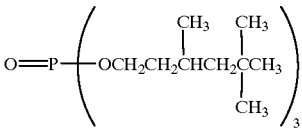
Oil-4 tricyclohexyl phosphate
Oil-5 di-2-ethylhexyl succinate
Oil-6
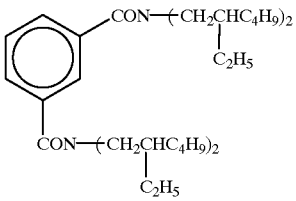
Oil-7
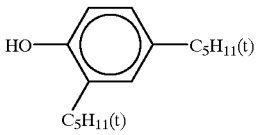
Oil-8
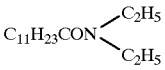
Oil-9
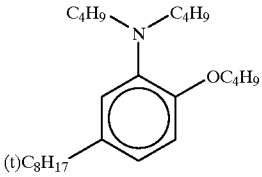

-continued
Cpd-A
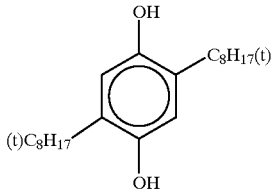
Cpd-B
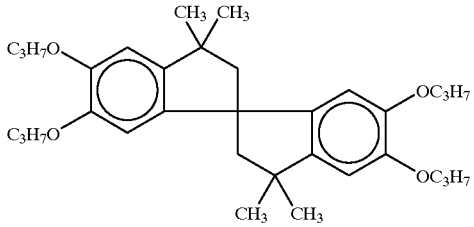
Cpd-C
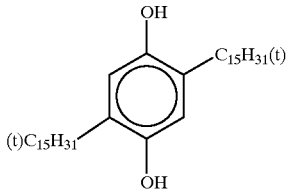
Cpd-D
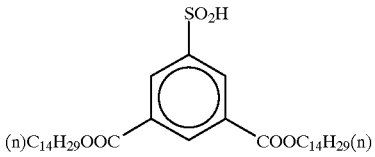
Cpd-E
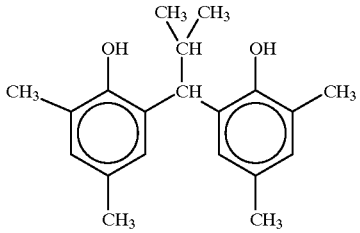
Cpd-F
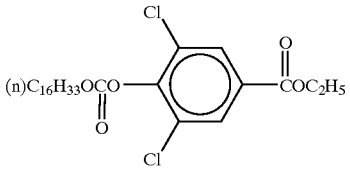
Cpd-G
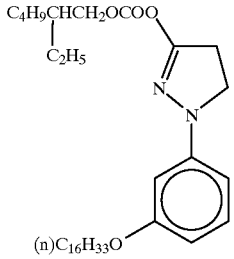
Cpd-H
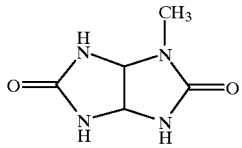
Cpd-I
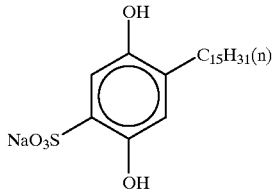
Cpd-J
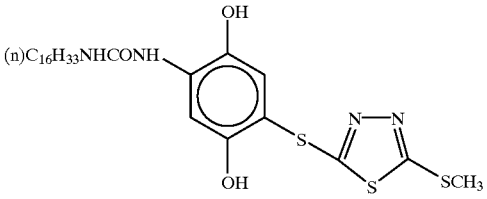
Cpd-K
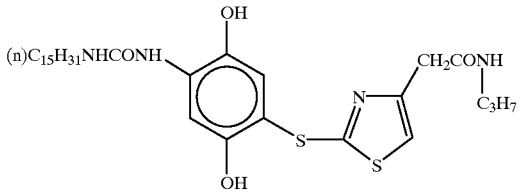
Cpd-L
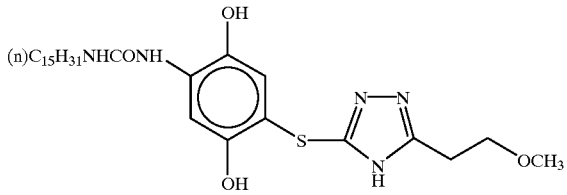

-continued
Cpd-M
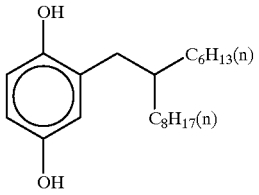
Cpd-N
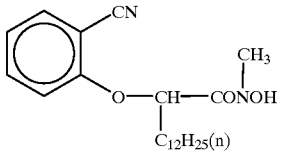
Cpd-O
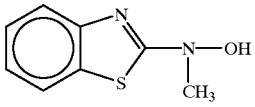
Cpd-P
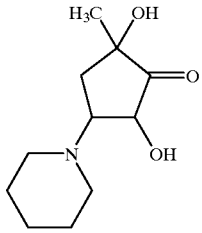
Cpd-Q
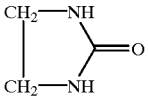
U-1
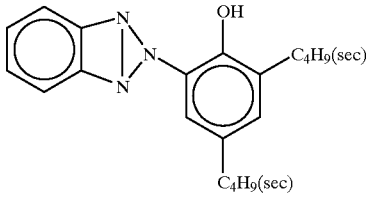
U-2
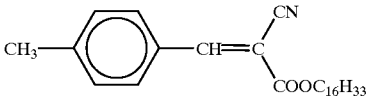
U-3
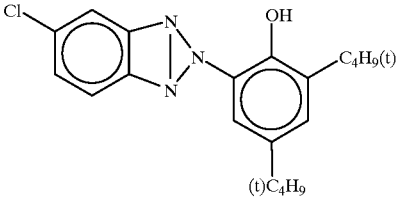
U-4
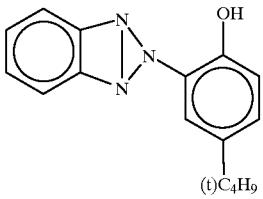
U-5
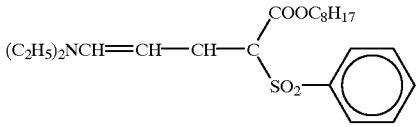
U-6
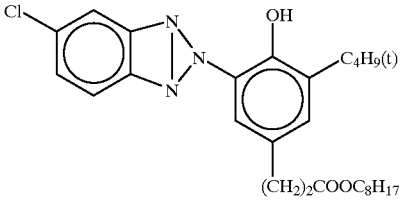
S-1
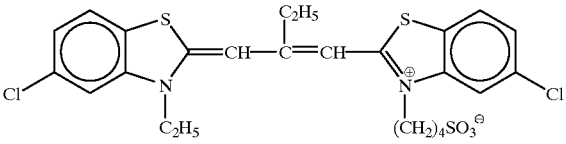

-continued
S-2
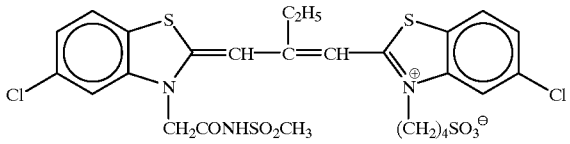
S-3
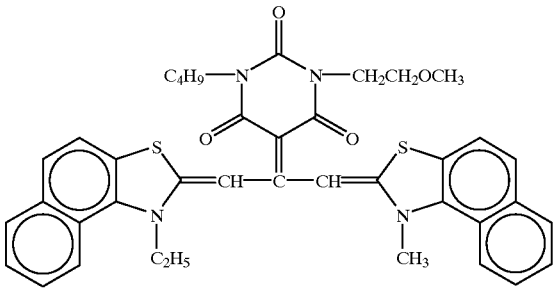
S-4
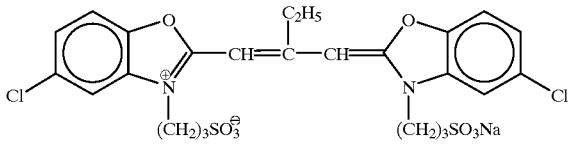
S-5
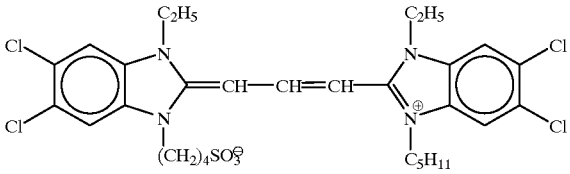
S-6
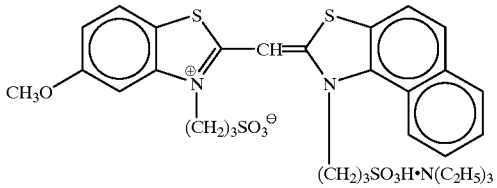
S-7
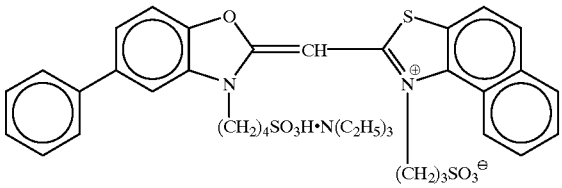
S-8
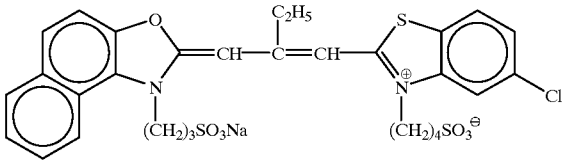
S-9
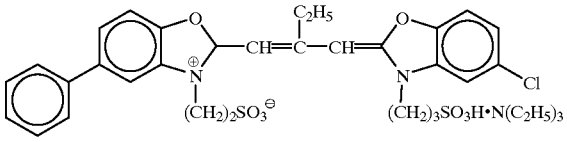
S-10
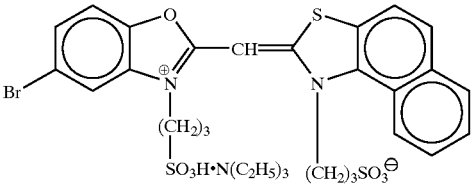
S-11
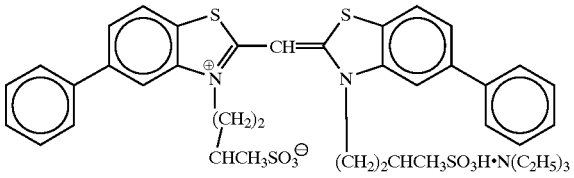
S-12
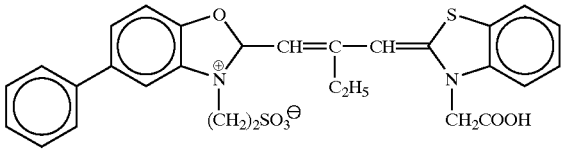
S-13
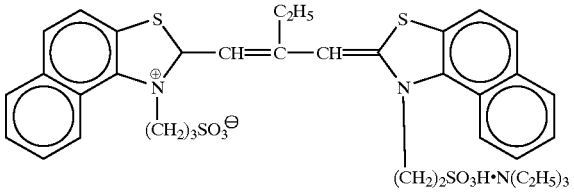

-continued
S-14
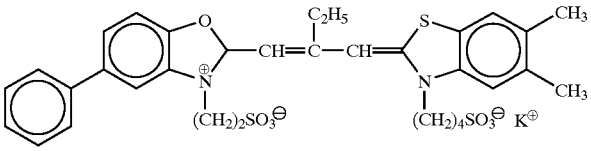
D-1
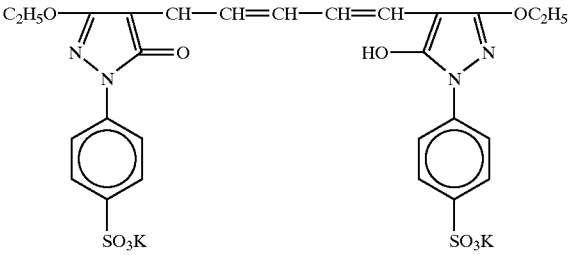
D-2
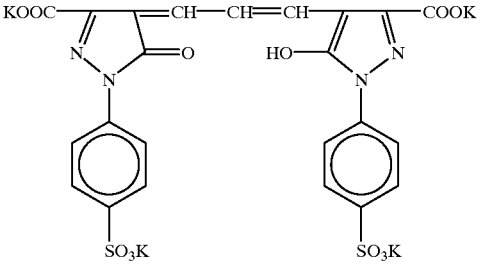
D-3
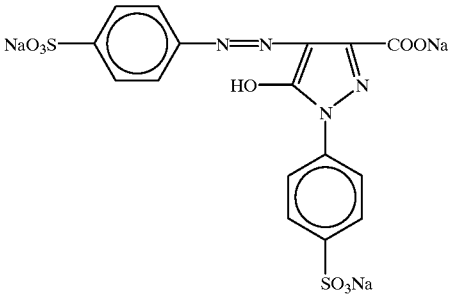
D-4
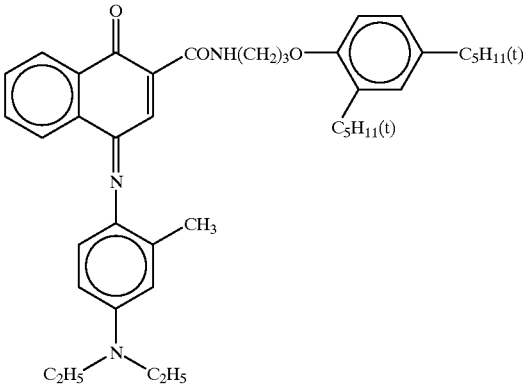
D-5
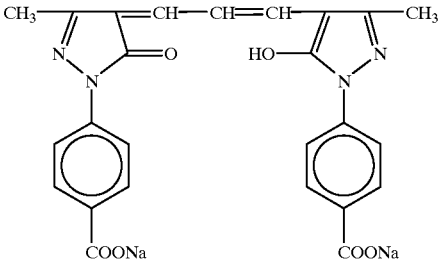
D-6
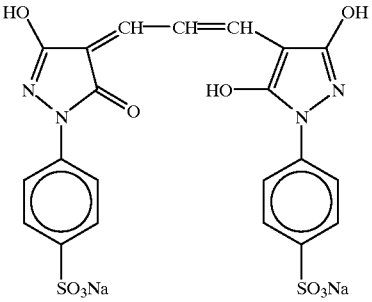
D-7
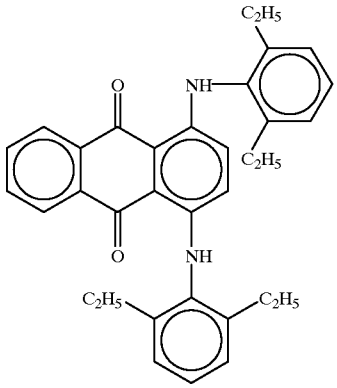

-continued
D-8
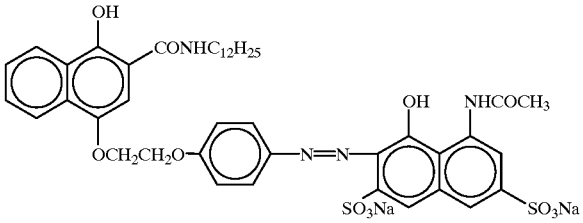
D-9
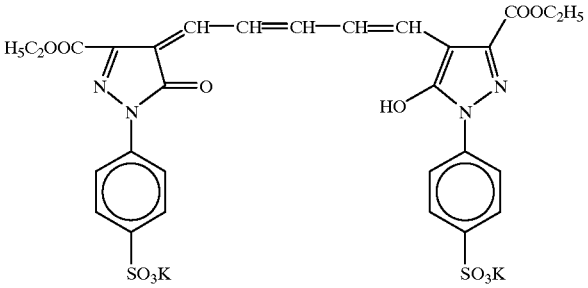
E-1
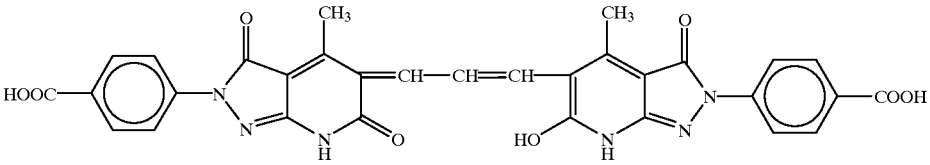
E-2
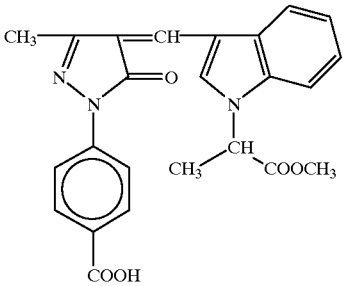
H-1
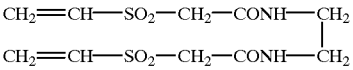
W-1
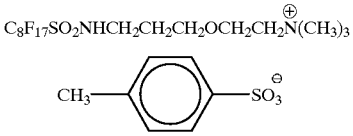
W-2
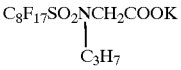
W-3
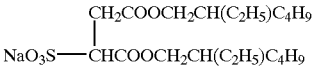
W-4
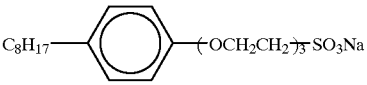
W-5
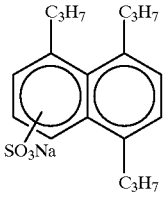
W-6
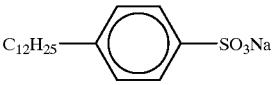
W-7
$C_8F_{17}SO_3Li$
P-1
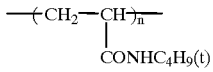
(n = 100~1000)
P-2
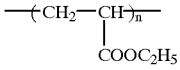
SO-1
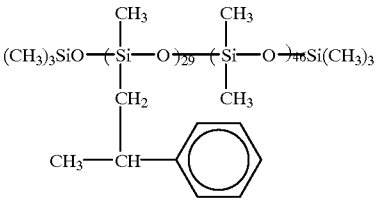

-continued (n = 100~1000)

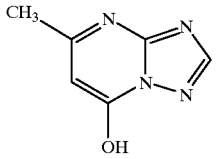

F-1

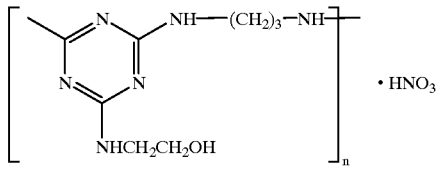

(n = 3~4)

F-2

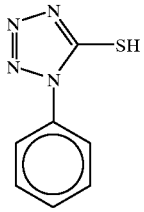

F-3

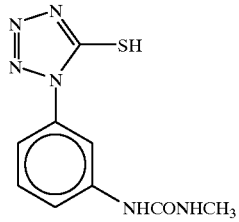

F-4

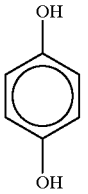

F-5

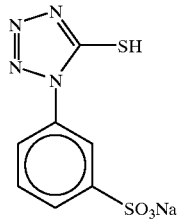

F-6

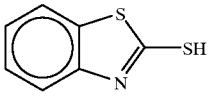

F-7

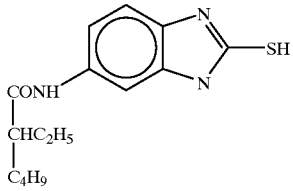

F-8

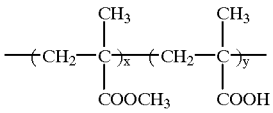

x/y = 90/10 (mass ratio)

B-1

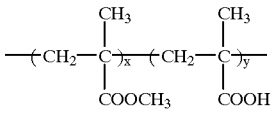

x/y = 60/40 (mass ratio)

B-2

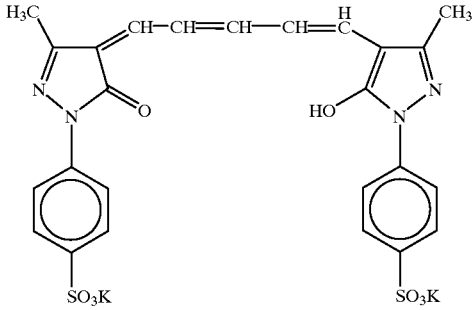

D-10

Preparation of dispersions of organic solid disperse dyes (Preparation of dispersion of dye E-1)

100 g of Pluronic F88 (an ethylene oxide-propylene oxide block copolymer) manufactured by BASF CORP. and water were added to a wet cake of the dye E-1 (the net weight of E-1 was 270 g), and the resultant material was stirred to make 4,000 g. Next, the Ultra Visco Mill (UVM-2) manufactured by Imex K.K. was filled with 1,700 mL of zirconia beads with an average grain size of 0.5 mm, and the slurry was milled through the UVM-2 at a peripheral speed of approximately 10 m/sec and a discharge rate of 0.5 L/min for 2 hrs. The beads were filtered out, and water was added to dilute the material to a dye concentration of 3%. After that, the material was heated to 90° C. for 10 hrs for stabilization. The average grain size of the obtained fine dye grains was 0.30 μm, and the grain size distribution (grain size standard deviation×100/average grain size) was 20%.

(Making of solid dispersion of dye E-2)

Water and 270 g of W-4 were added to 1,400 g of a wet cake of E-2 containing 30 mass % of water, and the resultant material was stirred to form a slurry having an E-2 concentration of 40 mass %. Next, the Ultra Visco Mill (UVM-2) manufactured by Imex K.K. was filled with 1,700 mL of zirconia beads with an average grain size of 0.5 mm, and the slurry was milled through the UVM-2 at a peripheral speed of approximately 10 m/sec and a discharge rate of 0.5 L/min for 8 hr, thereby obtaining a solid fine-grain dispersion of E-2. This dispersion was diluted to 20 mass % by ion exchange water to obtain a solid fine-grain dispersion. The average grain size was 0.15 μm.

Samples 201 to 208, 301 to 308, 401 to 408, and 501 to 508 were formed by replacing the couplers C-4, C-7, C-8, and C-12 and the high-boiling organic solvents in the 9th, 10th, and 11th layers of sample 101 as shown in Table 5. The replacement was done by dissolving the couplers, high-boiling organic solvents, and an oil-soluble component contained in the same layer in ethyl acetate whose amount was four times the total mass of these components, and adding surfactants W-3 and W-5 and an aqueous gelatin solution to disperse the material by emulsification.

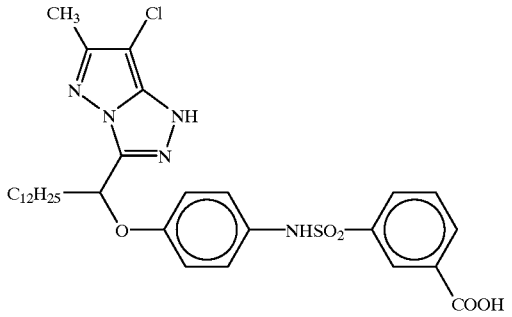

(M-26 described in JP-A-7- 64257)

TABLE 5

| Base | Couplers: As described in text Sample number | Comparative coupler A Sample number | (7) Sample number | (7) Sample number | (14) Sample number |
|---|---|---|---|---|---|
| A | 101 (Comparative example) | 201 (Comparative example) | 301 (Comparative example) | 401 (Comparative example) | 501 (Comparative example) |
| B | 102 (Comparative example) | 202 (Comparative example) | 302 (Present invention) | 402 (Present invention) | 502 (Present invention) |
| C | 103 (Comparative example) | 203 (Comparative example) | 303 (Comparative example) | 403 (Comparative example) | 503 (Comparative example) |

TABLE 5-continued

| Base | Couplers: As described in text Sample number | Comparative coupler A Sample number | (7) Sample number | (7) Sample number | (14) Sample number |
|---|---|---|---|---|---|
| D | 104 (Comparative example) | 204 (Comparative example) | 304 (Present invention) | 404 (Present invention) | 504 (Present invention) |
| E | 105 (Comparative example) | 205 (Comparative example) | 305 (Present invention) | 405 (Present invention) | 505 (Present invention) |
| F | 106 (Comparative example) | 206 (Comparative example) | 306 (Present invention) | 406 (Present invention) | 506 (Present invention) |
| G | 107 (Comparative example) | 207 (Comparative example) | 307 (Comparative example) | 407 (Comparative example) | 507 (Comparative example) |
| H | 108 (Comparative example) | 208 (Comparative example) | 308 (Present invention) | 408 (Present invention) | 508 (Present invention) |

(Supplementary explanation)

In samples 201 to 208, tricresyl phosphate was added to a comparative coupler A such that the addition amount was 0.5 times as a mass ratio.

In samples 301 to 308, tricresyl phosphate was added to a coupler (7) such that the addition amount was 0.5 times as a mass ratio.

In samples 401 to 408, tricresyl phosphate was added to the coupler (7) such that the addition amount was 0.1 times as a mass ratio.

In samples 501 to 508, a high-boiling organic solvent Oil-6 was added to a coupler (14) such that the addition amount was 0.2 times as a mass ratio.

In this example, the following development (development A) was performed.

| Processing Step | Time | Temperature | Tank volume | Replenishment rate |
|---|---|---|---|---|
| 1st development | 6 min | 38° C. | 12 L | 2,200 mL/m$^2$ |
| 1st washing | 2 min | 38° C. | 4 L | 7,500 mL/m$^2$ |
| Reversal | 2 min | 38° C. | 4 L | 1,100 mL/m$^2$ |
| Color development | 6 min | 38° C. | 12 L | 2,200 mL/m$^2$ |
| Pre-bleaching | 2 min | 38° C. | 4 L | 1,100 mL/m$^2$ |
| Bleaching | 6 min | 38° C. | 12 L | 220 mL/m$^2$ |
| Fixing | 4 min | 38° C. | 8 L | 1,100 mL/m$^2$ |
| 2nd washing | 4 min | 38° C. | 8 L | 7,500 mL/m$^2$ |
| Final rinsing | 1 min | 25° C. | 2 L | 1,100 mL/m$^2$ |

The compositions of the processing solutions were as follows.

| <1st developer> | <Tank solution> | <Replenisher> |
|---|---|---|
| Nitrilo-N,N,N-trimethylene phosphonic acid · pentasodium salt | 1.5 g | 1.5 g |
| Diethylenetriamine pentaacetic acid · pentasodium salt | 2.0 g | 2.0 g |

-continued

| <1st developer> | <Tank solution> | <Replenisher> |
|---|---|---|
| Sodium sulfite | 30 g | 30 g |
| Hydroquinone · potassium monosulfonate | 20 g | 20 g |
| Potassium carbonate | 15 g | 20 g |
| Potassium bicarbonate | 12 g | 15 g |
| 1-phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethyleneglycol | 13 g | 15 g |
| Water to make | 1,000 mL | 1,000 mL |
| pH | 9.60 | 9.60 |

The pH was adjusted by sulfuric acid or potassium hydroxide.

| <Reversal solution> | <Tank solution> | <Replenisher> |
|---|---|---|
| Nitrilo-N,N,N-trimethylene phosphonic acid · pentasodium salt | 3.0 g | the same as tank solution |
| Stannous chloride · dihydrate | 1.0 g | |
| p-aminophenol | 0.1 g | |
| Sodium hydroxide | 8 g | |
| Glacial acetic acid | 15 mL | |
| Water to make | 1,000 mL | |
| pH | 6.00 | |

The pH was adjusted by acetic acid or sodium hydroxide.

| <Color developer> | <Tank solution> | <Replenisher> |
|---|---|---|
| Nitrilo-N,N,N-trimethylene phosphonic acid · pentasodium salt | 2.0 g | 2.0 g |
| Sodium sulfite | 7.0 g | 7.0 g |
| Trisodium phosphate · dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-N-(β-methanesulfon amidoethyl)-3-methyl-4 aminoaniline · 3/2 sulfuric acid · monohydrate | 11 g | 11 g |
| 3,6-dithiaoctane-1,8-diol | 1.0 g | 1.0 g |
| Water to make | 1,000 mL | 1,000 mL |
| pH | 11.80 | 12.00 |

The pH was adjusted by sulfuric acid or potassium hydroxide.

| <Pre-bleaching solution> | <Tank solution> | <Replenisher> |
|---|---|---|
| Ethylenediaminetetraacetic acid · disodium salt · dihydrate | 8.0 g | 8.0 g |
| Sodium sulfite | 6.0 g | 8.0 g |
| 1-thioglycerol | 0.4 g | 0.4 g |
| Formaldehyde sodium bisulfite adduct | 30 g | 35 g |

-continued

| <Pre-bleaching solution> | <Tank solution> | <Replenisher> |
|---|---|---|
| Water to make | 1,000 mL | 1,000 mL |
| pH | 6.3 | 6.10 |

The pH was adjusted by acetic acid or sodium hydroxide.

| <Bleaching solution> | <Tank solution> | <Replenisher> |
|---|---|---|
| Ethylenediaminetetraacetic acid · disodium salt · dihydrate | 2.0 g | 4.0 g |
| Ethylenediaminetetraacetic acid · Fe(III) · ammonium · dihydrate | 120 g | 240 g |
| Potassium bromide | 100 g | 200 g |
| Ammonium nitrate | 10 g | 20 g |
| Water to make | 1,000 mL | 1,000 mL |
| pH | 5.70 | 5.50 |

The pH was adjusted by nitric acid or sodium hydroxide.

| <Fixing solution> | <Tank solution> | <Replenisher> |
|---|---|---|
| Ammonium thiosulfate | 80 g | the same as tank solution |
| Sodium sulfite | 5.0 g | |
| Sodium bisulfite | 5.0 g | |
| Water to make | 1,000 mL | |
| pH | 6.60 | |

The pH was adjusted by acetic acid or ammonia water.

| <Stabilizer> | <Tank solution> | <Replenisher> |
|---|---|---|
| 1,2-benzoisothiazoline-3-one | 0.02 g | 0.03 g |
| Polyoxyethylene-p-monononyl phenylether (average polymerization degree = 10) | 0.3 g | 0.3 g |
| Polymaleic acid (average molecular weight = 2,000) | 0.1 g | 0.15 g |
| Water to make | 1,000 mL | 1,000 mL |
| pH | 7.0 | 7.0 |

In the above development process, the solution was continuously circulated and stirred in each bath. In addition, a blowing pipe having small holes 0.3 mm in diameter formed at intervals of 1 cm was attached to the lower surface of each tank to continuously blow nitrogen gas to stir the solution.

(Evaluation of samples)

(Evaluation of storage stability)

Samples 101 to 508 were cut into rectangles 10.5 cm wide and 12.5 cm long. In a room controlled at a temperature of 25° C. and a humidity of 55%, 10 such sample pieces were overlapped in the same direction and placed in a bag made of light-shielding paper on the two sides of which polyethylene was laminated. After being deaerated, the bag was sealed by fusing the opening with heat.

Two sets of samples thus processed were prepared. One set was stored in an atmosphere at 40° C. and 55% for three months, and the other set was stored in a freezer at −20° C. for the same period, thereby aging the samples. After that, each bag was opened, and the fifth film from the top was taken out from the overlapped samples and exposed (exposure time 1/100 sec) to white light at a color temperature of 4,800° K. via a wedge having a continuously changing density. The exposed film was subjected to the above development, and the density was measured. (Maximum magenta density after storage in freezer)−(maximum magenta density after storage at 40° C. and 55%) was calculated as ΔDG(A).

Strips formed from samples 101 to 508 were stored, without being sealed as described above, in an atmosphere at 40° C. and 55% for three months and in a freezer for the same period, and the results were compared. A maximum magenta density was taken as a characteristic value, and a difference between the samples stored in the freezer and the samples stored at a high temperature was similarly calculated as ΔDG(B).

In addition, the value of ΔDG(B) was subtracted from the value of ΔDG(A) to calculate the degree of deterioration of the storage stability caused by sealing. For example, ΔDG(A)−ΔDG(B)=−0.15 represents that a decrease of the maximum magenta density worsened by a density of 0.15.

(Evaluation of unevenness)

Samples 101 to 508 were cut into rectangles 10.5 cm wide and 12.5 cm long. These cut samples were evenly exposed under exposure conditions by which a neutral gray density of 0.6 to 0.7 was given, and subjected to the development A. After the development, the entire surface of each sample was measured at intervals of 1 cm to calculate a difference between low-magenta-density portions and high-magenta-density portions (an average difference between five low-density portions and five high-density portions was calculated). The results are shown in Table 6.

TABLE 6

Results of evaluation

| Sample | | ΔDG(A)−ΔDG(B) | ΔDG(B) | Unevenness |
|---|---|---|---|---|
| 101 | (Comparative example) | −0.15 | −0.35 | 0.02 |
| 102 | (Comparative example) | −0.30 | −0.35 | 0.02 |
| 103 | (Comparative example) | −0.15 | −0.35 | 0.02 |
| 104 | (Comparative example) | −0.30 | −0.30 | 0.02 |
| 105 | (Comparative example) | −0.25 | −0.38 | 0.01 |
| 106 | (Comparative example) | −0.35 | −0.38 | 0.01 |
| 107 | (Comparative example) | −0.08 | −0.38 | 0.01 |
| 108 | (Comparative example) | −0.35 | −0.38 | 0.01 |
| 201 | (Comparative example) | −0.08 | −0.40 | 0.04 |
| 202 | (Comparative example) | −0.10 | −0.40 | 0.04 |
| 203 | (Comparative example) | −0.08 | −0.40 | 0.04 |
| 204 | (Comparative example) | −0.10 | −0.38 | 0.05 |
| 205 | (Comparative example) | −0.10 | −0.40 | 0.05 |
| 206 | (Comparative example) | −0.10 | −0.40 | 0.05 |
| 207 | (Comparative example) | −0.05 | −0.40 | 0.07 |
| 208 | (Comparative example) | −0.10 | −0.40 | 0.05 |
| 301 | (Comparative example) | −0.05 | −0.35 | 0.02 |
| 302 | (Present invention) | −0.05 | −0.30 | 0.02 |
| 303 | (Comparative example) | −0.05 | −0.35 | 0.02 |
| 304 | (Present invention) | −0.05 | −0.28 | 0.02 |
| 305 | (Present invention) | −0.05 | −0.30 | 0.02 |
| 306 | (Present invention) | −0.05 | −0.30 | 0.02 |
| 307 | (Comparative example) | −0.05 | −0.30 | 0.05 |
| 308 | (Present invention) | −0.05 | −0.30 | 0.01 |
| 401 | (Comparative example) | −0.03 | −0.35 | 0.01 |
| 402 | (Present invention) | −0.03 | −0.30 | 0.01 |
| 403 | (Comparative example) | −0.03 | −0.30 | 0.01 |
| 404 | (Present invention) | −0.03 | −0.28 | 0.01 |
| 405 | (Present invention) | −0.03 | −0.30 | 0.01 |
| 406 | (Present invention) | −0.03 | −0.30 | 0.01 |
| 407 | (Comparative example) | −0.03 | −0.30 | 0.05 |
| 408 | (Present invention) | −0.03 | −0.35 | 0.005 |
| 501 | (Comparative example) | −0.03 | −0.30 | 0.01 |
| 502 | (Present invention) | −0.02 | −0.30 | 0.01 |
| 503 | (Comparative example) | −0.03 | −0.30 | 0.01 |
| 504 | (Present invention) | −0.02 | −0.28 | 0.01 |
| 505 | (Present invention) | −0.02 | −0.35 | 0.01 |
| 506 | (Present invention) | −0.02 | −0.35 | 0.01 |
| 507 | (Comparative example) | −0.02 | −0.30 | 0.05 |
| 508 | (Present invention) | −0.02 | −0.30 | 0.005 |

The comparison of samples 101 to 108 in Table 6 shows that the storage stability of a sample having an undercoat layer containing acetone deteriorated by sealing when the two surfaces of a cellulose triacetate support were undercoated or when the thickness of the support was large.

In contrast, when the comparative coupler A was replaced with couplers of the present invention, almost no such deterioration of the storage stability by sealing was observed.

When the comparative coupler A was used, however, magenta generation unevenness was worse than in samples 101 to 108. By contrast, the degree of unevenness was significantly improved in the samples of the present invention in which couplers of the present invention were used together with undercoating using acetone.

That is, the combination of the present invention solved the problem (unevenness) when pyrazolotriazole couplers were used and the problem of deterioration of the storage stability caused by undercoating at the same time.

Of the samples of the present invention, samples 401 to 408 in which the tricresyl phosphate addition amounts were reduced compared to samples 301 to 308 gave more preferred results.

EXAMPLE-2

A base I was formed by making the time during which dried air at 100° C. was blown after undercoating longer than that for the base D. This base I was coated with photosensitive emulsion layers as in Example-1 to form samples 109, 209, 309, 409, and 509. The residual amount of acetone in samples using the base D was 0.30 mass %, and that in samples using the base I was 0.03 mass %. The storage stability was evaluated in the same manner as in Example-1. Consequently, the difference between storage in the sealed state and storage in an open system reduced even in sample 109.

Samples 104, 204, 304, 404, and 504 and samples 109, 209, 309, 409, and 509 were cut into strips 8 cm wide and 1.5 m long. A 1.5-cm long portion at one end of each strip was bent and fixed, and a weight of 100 g was attached to the other end. After being raised to an appropriate height, the weight was dropped to evaluate the breaking strength of the film.

As a consequence, samples using the base I started to break when the weight was raised to a height lower than that for samples using the base D.

As described above, drying after undercoating cannot be unlimitedly enhanced when the brittleness of the base is taken into consideration. Therefore, improvements of the storage stability by couplers of the present invention are significant.

EXAMPLE-3

Samples 2101 to 2508 were formed following the same procedures as for samples 101 to 508 except that the 12th and 14th layers were removed. When these samples 2101 to 2508 were evaluated in the same manner as in Example-1, the present invention gave preferred results.

EXAMPLE-4

Samples 3101 to 3508 were formed following the same procedures as for samples 101 to 508 except that the 4th, 5th, and 6th layers were changed as follows.

| 4th layer: Low-speed red-sensitive emulsion layer | | |
|---|---|---|
| Emulsion A | silver | 0.10 g |
| Emulsion B | silver | 0.15 g |
| Emulsion C | silver | 0.15 g |
| Gelatin | | 0.70 g |
| Coupler CC-1 | | 0.10 g |
| Coupler C-6 | | 6.0 mg |
| Coupler C-9 | | 5.0 mg |
| Ultraviolet absorbent U-3 | | 0.010 g |
| Compound Cpd-I | | 0.020 g |
| Compound Cpd-D | | 3.0 mg |
| Compound Cpd-J | | 2.0 mg |
| High-boiling organic solvent Oil-A | | 0.025 g |
| Additive P-1 | | 0.020 g |
| **5th layer: Medium-speed red-sensitive emulsion layer** | | |
| Emulsion C | silver | 0.15 g |
| Emulsion D | silver | 0.15 g |
| Gelatin | | 0.70 g |
| Coupler CC-1 | | 0.15 g |
| Coupler C-6 | | 7.0 mg |
| Compound Cpd-D | | 4.0 mg |
| Ultraviolet absorbent U-3 | | 0.010 g |
| High-boiling organic solvent Oil-A | | 0.035 g |
| Additive P-1 | | 0.020 g |
| **6th layer: High-speed red-sensitive emulsion layer** | | |
| Emulsion E | silver | 0.15 g |
| Emulsion F | silver | 0.15 g |
| Gelatin | | 1.50 g |
| Coupler CC-1 | | 0.60 g |
| Coupler C-6 | | 0.010 g |
| Ultraviolet absorbent U-1 | | 0.010 g |
| Ultraviolet absorbent U-2 | | 0.010 g |
| High-boiling organic solvent Oil-6 | | 0.050 g |
| High-boiling organic solvent Oil-A | | 0.050 g |
| Compound Cpd-D | | 5.0 mg |
| Compound Cpd-K | | 1.0 mg |
| Compound Cpd-L | | 1.0 mg |
| Compound Cpd-F | | 0.030 g |
| Additive P-1 | | 0.10 g |

(Coupler CC-1)

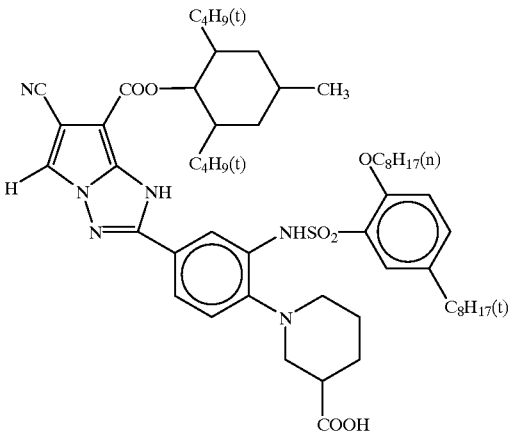

-continued

Oil-A

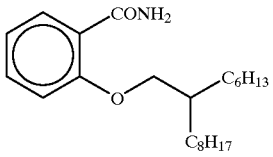

When samples 3101 to 3508 were evaluated in the same manner as for Example-1, the samples of the present invention gave preferred results.

EXAMPLE-5

Samples 104, 204, 304, 404, and 504 and samples 3104, 3204, 3304, 3404, and 3504 each using the base D were cut into strips 61 mm wide and 803 mm long. Each strip was wound into the form of a Brownie film together with light-shielding paper. The film was sealed in a bag made of a material on which an aluminum foil and polyethylene were laminated, and evaluated in the same manner as in Example-1.

Consequently, combinations with couplers of the present invention had high storage stability and gave favorable results.

EXAMPLE-6

Three types of light-sensitive materials having different supports were formed following the same procedures as for samples 3504, 3506, and 3508 except that a coupler (14) and high-boiling organic solvents were changed as shown in Table 7.

When each sample was evaluated in the same manner as in Example-1, the present invention gave favorable results.

TABLE 7

| Standard | Coupler | High-boiling organic solvent Number in ( ) indicates mass ratio to coupler |
|---|---|---|
| 6-1 | (6) | Oil-3 (0.2) |
| 6-2 | (7) | Oil-3 (0.3) |
| 6-3 | (7) | Oil-A (0.2) |
| 6-4 | (9) | Oil-6 (0.2) |
| 6-5 | (9) | No high-boiling organic solvent was used |
| 6-6 | (7) | No high-boiling organic solvent was used |
| 6-7 | (18) | Additive P-1 was added at mass ratio of 20% to coupler without using high-boiling organic solvent |
| 6-8 | (18) | Oil-2 (0.1) |
| 6-9 | (18) | Oil-6 (0.3) |
| 6-10 | (23) | Oil-1 (0.2) |
| 6-11 | (21) | Oil-3 (0.7) |
| 6-12 | (15) | Oil-6 (0.1) |
| 6-13 | (30) | Oil-3 (0.3) |
| 6-14 | (34) | No high-boiling organic solvent was used |
| 6-15 | (37) | No high-boiling organic solvent was used |
| 6-16 | (37) | Oil-2 (0.2) |
| 6-17 | (36) | Oil-6 (0.3) |
| 6-18 | Mix (37) and C-7 at molar ratio of 1:1 | Oil-3 (0.3), Mass ratio to total of (37) and C-7 |

EXAMPLE-7

Three types of light-sensitive materials having different supports were formed following the same procedures as for samples 3504, 3506, and 3508 except that a coupler (14) and high-boiling organic solvents were changed as shown in Table 8.

When each sample was evaluated in the same manner as in Example-1, the present invention gave favorable results.

TABLE 8

| Standard | Coupler | High-boiling organic solvent Number in () indicates mass ratio to coupler |
|---|---|---|
| 7-1 | (39) | Oil-2(0.1) |
| 7-2 | Mix (39) and coupler B at molar ratio of 8:2 | Oil-2(0.2) |
| 7-3 | (40) | Oil-2(0.1) |
| 7-4 | Mix (40) and coupler B at molar ratio of 7:3 | Oil-2(0.2) |
| 7-5 | (24) | Oil-2(0.4) |
| 7-6 | (13) | Oil-6(0.1) + Oil-2(0.1) |
| 7-7 | Mix (13) and coupler B and C-4 at molar ratio of 7:2:1 | Oil-2(0.2) |
| 7-8 | Mix (39) and coupler B and C-4 at molar ratio of 2:1 | Oil-6(0.1) + Oil-2(0.1) |
| 7-9 | Mix (14) and (39) and coupler B at molar ratio of 4:4:2 | Oil-2(0.5) |

Coupler B

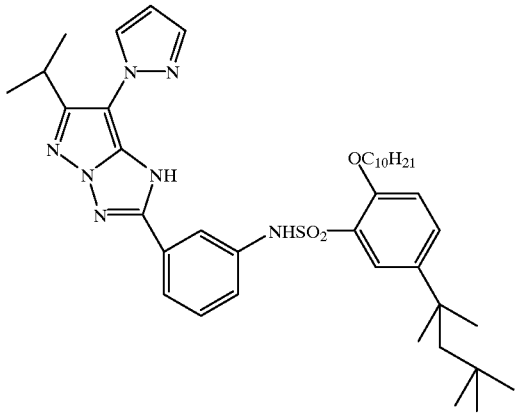

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photographic light-sensitive material having at least one blue-sensitive emulsion layer, at least one green-sensitive emulsion layer, and at least one red-sensitive emulsion layer on a transparent support, wherein the transparent support is a plastic support having two surfaces undercoated with an undercoat solution containing at least one compound selected from the group consisting of a water-miscible organic solvent except for alcohols, a substituted phenol having a molecular weight of 200 or less, and a substituted acetic acid in which at least one hydrogen atom on a methyl group of acetic acid is substituted with a halogen atom, and at least one photosensitive emulsion layer contains a coupler represented by formula (MC-I):

(MC-I)

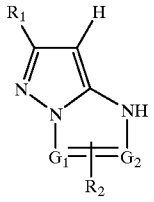

where $R_1$ represents a hydrogen atom or a substituent, one of $G_1$ and $G_2$ represents a carbon atom and the other represents a nitrogen atom, $R_2$ represents a substituent on one of $G_1$ and $G_2$ which is the carbon atom, and $R_1$ and $R_2$ may further have substituents, wherein a plurality of said couplers may be bonded together through $R_1$ or $R_2$ to form a polymer, or said coupler may be bonded to a polymer chain through $R_1$ or $R_2$.

2. A silver halide color photographic light-sensitive material having at least one blue-sensitive emulsion layer, at least one green-sensitive emulsion layer, and at least one red-sensitive emulsion layer on a transparent support, wherein the transparent support is a plastic support having a thickness of 150 to 2000 $\mu$m and having at least one surface undercoated with an undercoat solution containing at least one compound selected from the group consisting of a water-miscible organic solvent except for alcohols, a substituted phenol having a molecular weight of 200 or less, and a substituted acetic acid in which at least one hydrogen atom on a methyl group of acetic acid is substituted with a halogen atom, and at least one photosensitive emulsion layer contains a coupler represented by formula (MC-I):

(MC-I)

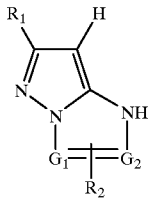

where $R_1$ represents a hydrogen atom or a substituent, one of $G_1$ and $G_2$ represents a carbon atom and the other represents a nitrogen atom, $R_2$ represents a substituent on one of $G_1$ and $G_2$ which is the carbon atom, and $R_1$ and $R_2$ may further have substituents, wherein a plurality of said couplers may be bonded together through $R_1$ or $R_2$ to form a polymer, or said coupler may be bonded to a polymer chain through $R_1$ or $R_2$.

3. The material according to claim 1, wherein the plastic support contains triacetyl cellulose as a main constituent.

4. The material according to claim 2, wherein the plastic support contains triacetyl cellulose as a main constituent.

5. The material according to claim 3, wherein the plastic support is undercoated with an undercoat solution containing at least acetone.

6. The material according to claim 4, wherein the plastic support is undercoated with an undercoat solution containing at least acetone.

7. The material according to claim 5, wherein the acetone content in the light-sensitive material is 0.05% to 3.0% as a mass ratio to the light-sensitive material.

8. The material according to claim 6, wherein the acetone content in the light-sensitive material is 0.05% to 3.0% as a mass ratio to the light-sensitive material.

9. The material according to claim 1, wherein, in formula (MC-I), $R_1$ represents a secondary or tertiary alkyl group, $G_1$ represents a carbon atom, and $G_2$ represents a nitrogen atom.

10. The material according to claim 2, wherein, in formula (MC-I), $R_1$ represents a secondary or tertiary alkyl group, $G_1$ represents a carbon atom, and $G_2$ represents a nitrogen atom.

11. The material according to claim 7, wherein, in formula (MC-I), $R_1$ represents a secondary or tertiary alkyl group, $G_1$ represents a carbon atom, and $G_2$ represents a nitrogen atom.

12. The material according to claim 8, wherein, in formula (MC-I), $R_1$ represents a secondary or tertiary alkyl group, $G_1$ represents a carbon atom, and $G_2$ represents a nitrogen atom.

13. The material according to claim 11, wherein a tricresyl phosphate content in the layer containing the coupler represented by formula (MC-I) is from 0 to less than 0.5 as a mass ratio to the coupler represented by formula (MC-1) contained in the same layer.

14. The material according to claim 12, wherein a tricresyl phosphate content in the layer containing the coupler represented by formula (MC-I) is from 0 to less than 0.5 as a mass ratio to the coupler represented by formula (MC-1) contained in the same layer.

15. The material according to claim 1, wherein, in formula (MC-I), $R_1$ represents a tertiary alkyl group, $G_1$ represents a carbon atom, $G_2$ represents a nitrogen atom, and $R_2$ represents a substituent represented by formula (BL-1) or (BL-2):

(BL-1)

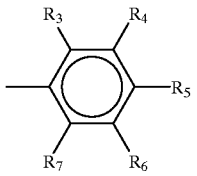

where each of $R_3$, $R_4$, $R_5$, $R_6$, and $R_7$ independently represents a hydrogen atom or a substituent, wherein at least one of them represents a substituent having a total of 4 to 70 carbon atoms and containing a substituted or unsubstituted alkyl group as a partial structure, or a substituent having a total of 6 to 70 carbon atoms and containing a substituted or unsubstituted aryl group as a partial structure, (BL-2)

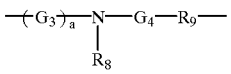

where $G_3$ represents a substituted or unsubstituted methylene group, a represents an integer from 1 to 3, $R_8$ represents a hydrogen atom, an alkyl group, or an aryl group, $G_4$ represents —CO— or —$SO_2$—, and $R_9$ represents a substituent having a total of 6 to 70 carbon atoms and containing a substituted or unsubstituted alkyl group or aryl group as a partial structure, wherein a is 2 or more, and a plurality of $G_3$'s may be the same or different.

16. The material according to claim 2, wherein, in formula (MC-I), $R_1$ represents a tertiary alkyl group, $G_1$ represents a carbon atom, $G_2$ represents a nitrogen atom, and $R_2$ is a substituent represented by formula (BL-1)

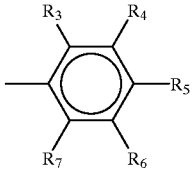

where each of $R_3$, $R_4$, $R_5$, $R_6$, and $R_7$ independently represents a hydrogen atom or a substituent, wherein at least one of them represents a substituent having a total of 4 to 70 carbon atoms and containing a substituted or unsubstituted alkyl group as a partial structure, or a substituent having a total of 6 to 70 carbon atoms and containing a substituted or unsubstituted aryl group as a partial structure, (BL-2)

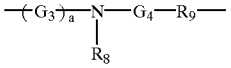

where $G_3$ represents a substituted or unsubstituted methylene group, a represents an integer from 1 to 3, $R_8$ represents a hydrogen atom, an alkyl group, or an aryl group, $G_4$ represents —CO— or —$SO_2$—, and $R_9$ represents a substituent having a total of 6 to 70 carbon atoms and containing a substituted or unsubstituted alkyl group or aryl group as a partial structure, wherein a is 2 or more, and a plurality of $G_3$'s may be the same or different.

* * * * *